US010384477B2

(12) United States Patent
Nakahata et al.

(10) Patent No.: US 10,384,477 B2
(45) Date of Patent: Aug. 20, 2019

(54) PRINTING APPARATUS

(71) Applicant: SEIKO EPSON CORPORATION, Tokyo (JP)

(72) Inventors: Akinobu Nakahata, Nagano (JP); Takamasa Ikagawa, Nagano (JP); Hiroki Chino, Nagano (JP); Yosaku Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/014,063

(22) Filed: Jun. 21, 2018

(65) Prior Publication Data

US 2018/0297379 A1 Oct. 18, 2018

Related U.S. Application Data

(63) Continuation of application No. 15/331,260, filed on Oct. 21, 2016, now Pat. No. 10,029,489.

(30) Foreign Application Priority Data

Nov. 2, 2015 (JP) ..... 2015-215777

(51) Int. Cl.
*B41J 11/42* (2006.01)
*B41J 13/076* (2006.01)
(Continued)

(52) U.S. Cl.
CPC ..... *B41J 11/42* (2013.01); *B41J 3/60* (2013.01); *B41J 13/076* (2013.01); *B41J 29/17* (2013.01); *B65H 9/006* (2013.01); *B65H 85/00* (2013.01); *B65H 2404/1115* (2013.01); *B65H 2404/133* (2013.01); *B65H 2404/1321* (2013.01);
(Continued)

(58) Field of Classification Search
CPC . B41J 13/02; B41J 13/03; B41J 13/042; B41J 13/072; B41J 13/10; B41J 13/103; B41J 13/18; B41J 13/26; B41J 13/32; B41J 13/0018; B41J 13/0009; B41J 13/0045;
(Continued)

(56) References Cited

U.S. PATENT DOCUMENTS 5,163,674 A * 11/1992 Parks ..... B41J 13/076 101/416.1
5,523,848 A 6/1996 Musso et al.
(Continued)

FOREIGN PATENT DOCUMENTS

JP 2000-168985 A 6/2000
JP 2004-262574 A 9/2004

OTHER PUBLICATIONS

The Extended European Search Report for the corresponding European Application No. 16196801.1 dated Apr. 5, 2017.

*Primary Examiner* — Scott A Richmond

(57) ABSTRACT

A transport roller, adapted to be used in a transport apparatus that transports a medium, includes a shaft, and a wheel group. The wheel group includes a plurality of toothed wheels arrayed in a direction in which the shaft extends, the plurality of toothed wheels being held by a holder which is held by the shaft. A plurality of teeth portions are provided on a peripheral surface of the wheel group, the plurality of teeth portions being disposed to be shifted in position from each other in a circumferential direction of the wheel group when the wheel group is viewed from the direction in which the shaft extends.

7 Claims, 20 Drawing Sheets

(51) Int. Cl.

| | |
|---|---|
| ***B41J 3/60*** | (2006.01) |
| ***B41J 29/17*** | (2006.01) |
| ***B65H 85/00*** | (2006.01) |
| ***B65H 9/00*** | (2006.01) |

(52) U.S. Cl.
CPC ..... *B65H 2404/1341* (2013.01); *B65H 2404/143* (2013.01); *B65H 2404/144* (2013.01)

(58) Field of Classification Search
CPC . B41J 13/009; B41J 3/60; B41J 11/42; B65H 2404/1115
See application file for complete search history.

(56) References Cited

U.S. PATENT DOCUMENTS

| | | | | |
|---|---|---|---|---|
| 2010/0276863 | A1 | 11/2010 | Yano | |
| 2012/0319345 | A1 | 12/2012 | Asada et al. | |
| 2013/0135411 | A1 | 5/2013 | Ito et al. | |
| 2014/0091517 | A1* | 4/2014 | Okumura ..... | B65H 5/062 271/272 |
| 2015/0274477 | A1 | 10/2015 | Kodama | |

* cited by examiner

PRINTING APPARATUS

CROSS-REFERENCE TO RELATED APPLICATIONS

This is a continuation application of U.S. patent application Ser. No. 15/331,260 filed on Oct. 21, 2016, which claims priority to Japanese Patent Application No. 2015-215777 filed on Nov. 2, 2015. The entire disclosure of Japanese Patent Application No. 2015-215777 is hereby incorporated herein by reference.

BACKGROUND

Technical Field

The present invention relates to a printing apparatus capable of printing both side surfaces of a medium that is transported, and a transport roller adapted to be used in a transport apparatus that transports the medium in the printing apparatus.

Related Art

An ink jet type printer that includes a printing unit that prints images or the like on a sheet of paper, which is an example of a medium, by discharging ink, which is an example of a liquid, to the sheet has been known as a kind of printing apparatus. In such a printer, if a sheet is transported in a skewed manner to the printing unit from a portion of a transport path upstream of the printing unit, printing is not properly performed on the sheet, so that the print quality deteriorates. Therefore, in this type of printer, a site upstream of the printing unit along the transport path is provided with a register roller that performs a skew correction in which a leading end of a sheet transported from upstream of that site is caused to have firm or pressing contact with the roller so as to correct the skew, if any, of the sheet and then transports the sheet toward the printing unit (e.g., Japanese Laid-open Patent Publication No. 2004-262574).

Such a related-art printer sometimes performs a two-side printing in which after a surface of a sheet is printed by discharging ink thereto, the reverse surface is also printed by switching back the sheet. Then, at the time of printing the reverse side in the two-side printing, the obverse surface of the sheet, which has been already printed by discharged ink, contacts the peripheral surface of the register roller. Therefore, at the time of the reverse-side printing, there is a risk that the peripheral surface of the register roller may become stained and then the stain may be transferred to another sheet that subsequently contacts the register roller.

SUMMARY

An advantage of some aspects of the invention is that a printing apparatus capable of reducing the risk of a medium being stained by a correction roller pair that corrects skew of the medium by contacting the medium, and a transport roller adapted to be used in a transport apparatus that transports the medium in the printing apparatus.

Measures for solving the foregoing task and the operation and advantageous effects thereof will be described below.

A transport roller according to one aspect of the present invention is adapted to be used in a transport apparatus that transports a medium, the transport roller including a shaft, and a wheel group. The wheel group includes a plurality of toothed wheels arrayed in a direction in which the shaft extends, the plurality of toothed wheels being held by a holder which is held by the shaft. A plurality of teeth portions are provided on a peripheral surface of the wheel group, the plurality of teeth portions being disposed to be shifted in position from each other in a circumferential direction of the wheel group when the wheel group is viewed from the direction in which the shaft extends.

BRIEF DESCRIPTION OF THE DRAWINGS

The invention will be described with reference to the accompanying drawings, wherein like numbers reference like elements.

DETAILED DESCRIPTION OF EXEMPLARY EMBODIMENTS

Hereinafter, as an exemplary embodiment of the printing apparatus of the invention, an ink jet type printer that includes a printing unit capable of discharging ink, which is an example of a liquid, and that prints images, including characters, graphics, etc., by discharging ink to a paper sheet, which is an example of a sheet-shaped medium, will be described with reference to the drawings. Note that the printer in this exemplary embodiment prints on a medium by using a water-based ink that contains water as a solvent.

Figure 1:
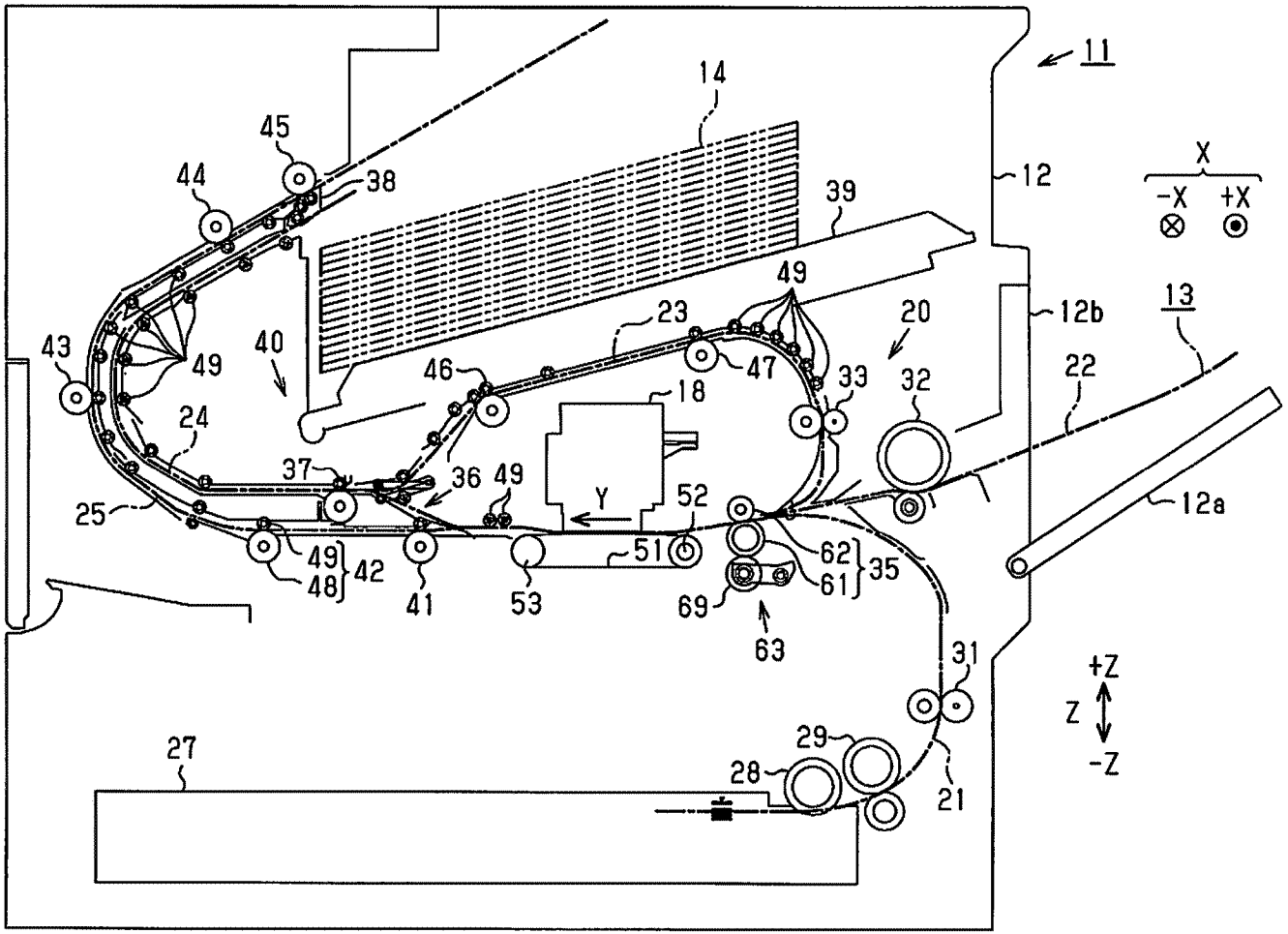
FIG. 1 is a schematic side view showing an overall construction of an exemplary embodiment of a printer that is an example of a printing apparatus according to the invention.

As shown in FIG. 1, a printer 11 as an example of the printing apparatus according to the exemplary embodiment includes as an apparatus main body a generally rectangular parallelepiped casing 12 made up of a plurality of exterior cases and the like, and further has inside the casing 12 a transport path 13 along which a sheet 14 is transported as indicated by a thick one-dot chain line in FIG. 1. Along the transport path 13 there are provided a plurality of roller pairs that each transport the sheet 14 by rotating while nipping the sheet 14 between the two rollers, a transport belt 51 that transports the sheet 14 while supporting the sheet 14 from a gravitational direction −Z side (lower side) in a vertical direction Z, and a printing unit 18 that discharges the ink to the sheet 14 that is transported. These components are attached to the casing 12.

In the exemplary embodiment, the printing unit 18 is provided as a so-called line head that has its length in a width direction X that intersects (at the right angle in this example) with a transport direction Y of the sheet 14 and that includes liquid discharge heads capable of simultaneously discharging the ink substantially throughout the length of the line head. Incidentally, in order to make the following description simple and easy, the two width directions X are defined separately as follows. That is, the leftward direction in a view from the upstream side in the transport direction Y (i.e., the direction from the plane of the drawing to the obverse side is termed +X direction, and the rightward direction in a view from the upstream side in the transport direction Y (i.e., the direction from the plane of the drawing to the revere side) is termed −X direction. The printing unit 18 provided in the form of a line head performs printing by discharging the ink from an antigravitational direction +Z side (upper side) to the sheet 14 that is transported while being supported by the transport belt 51. The transport path 13 is made up of a first feed path 21 and a second feed path 22 that are upstream of the printing unit 18 in the transport direction Y, a third feed path 23 that is downstream of the printing unit 18 in the transport direction Y, a branch path 24, and a discharge path 25.

The first feed path 21 is a path that connects the printing unit 18 and a sheet cassette 27 that is provided in a bottom portion of the casing 12, that is, at a gravitational direction −Z side in the casing 12. The first feed path 21 is provided with a pickup roller 28 that sends out an uppermost sheet 14 of the sheets 14 mounted in a stacked state on the sheet cassette 27 and a separator roller 29 that separates one sheet 14 at a time from the sheets 14 sent out by the pickup roller 28. Furthermore, a first feed roller pair 31 is provided downstream of the separator roller 29 in the transport direction Y.

The second feed path 22 is a path connecting the printing unit 18 and an insertion portion 12*b* that is exposed by opening a cover 12*a* that is provided on a side surface of the casing 12. Then, the second feed path 22 is provided with a second feed roller pair 32 that nips and transports the sheet 14 inserted from the insertion portion 12*b*. Furthermore, along the transport path 13, a correction roller pair 35 that corrects skew of the sheet 14 is provided between a location at which the first feed path 21, the second feed path 22, and the third feed path 23 meet and a location at which the printing unit 18 is provided. Furthermore, the third feed path 23 is provided with a third feed roller pair 33.

The third feed path 23 is a path that is provided so as to encircle the printing unit 18 and that is used to return the sheet 14 having passed under the printing unit 18 once to the upstream side of the printing unit 18. A branching mechanism 36 is provided at the downstream side of the printing unit 18. A branch path 24 branching from the discharge path 25 is provided with a branching roller pair 37 capable of both forward rotation and reverse rotation. This branch path 24 continuously connects to the discharge path 25 at the location at which the branching mechanism 36 is provided and also continuously connects to the third feed path 23 without passing through a location that faces the printing unit 18 and that is a location at which the sheet 14 is printed by the printing unit 18.

That is, the first, second and third feed paths 21, 22 and 23 form a feed path 20 along which the sheet 14 is transported toward the printing unit 18. The sheet 14 transported along the feed path 20 has, at its leading end, firm contact with the correction roller pair 35 that has stopped rotating, so that obliqueness of the sheet relative to the transport direction Y, that is, skew thereof, is corrected. Then, the sheet 14, whose skew has been corrected, is transported to the printing unit 18 by subsequently rotating the correction roller pair 35.

The discharge path 25 is a path connecting the printing unit 18 and a discharge port 38 through which the printed sheet 14 is discharged. Incidentally, the sheet 14 discharged through the discharge port 38 is placed on the discharge tray 39. The discharge path 25 is provided with at least one transport roller pair (first to fifth transport roller pairs 41 to 45 in this exemplary embodiment). Furthermore, the third feed path 23 is provided with a sixth transport roller pair 46 and a seventh transport roller pair 47. These first to seventh transport roller pairs 41 to 47 nip and transport the printed sheet 14, to which ink has adhered.

That is, each of the first to seventh transport roller pairs 41 to 47 is made up of a cylindrical transport driving roller 48 that rotates on the basis of the drive force from a drive source and a transport driven roller 49 that is passively rotated as the transport driving roller 48 rotates. Furthermore, there are also provided other transport driven rollers 49 that are singularly provided without pairing with a transport driving roller 48. That is, the transport driven rollers 49 are provided on the third feed path 23, the branch path 24, and the discharge path 25 and, more specifically, on a side where a printed surface of the sheet 14 which has been printed (i.e., a surface of the sheet 14 to which ink, which is an example of a liquid, has been discharged and adhered) pass. Furthermore, some of the transport driven rollers 49 are provided in the intervals between the first to seventh transport roller pairs 41 to 47 in the transport direction Y and also between the printing unit 18 and adjacent ones of the transport roller pairs. On the other hand, the transport driving rollers 48 are provided on the side where a not-printed surface of the sheet 14 which has not been printed or the surface of the sheet 14 which has already been printed in the process of two-side printing pass.

In this exemplary embodiment, the transport belt 51, which faces the printing unit 18, transports the sheet 14 by turning around while supporting, due to electrostatic adsorption, the sheet 14 on its belt surface that is its outer peripheral surface. The transport belt 51 is an endless belt wrapped around two rollers of which one roller is a driving roller 52 that is rotationally driven by a drive source and the other roller is a driven roller 53 that is rotated as the belt turns. The transport belt 51 turns as the driving roller 52 rotates. When the transport belt 51 is turning, a charging roller (not graphically shown) that contacts the belt surface charges the transport belt 51 with static electricity. The transport belt 51 charged with static electricity adsorbs the sheet 14 on the flat belt surface on the antigravitational direction +Z side which is formed between the driving roller 52 and the driven roller 53 and transports the adsorbed sheet 14 in the transport direction Y while the sheet 14 faces the printing unit 18.

Furthermore, the printer 11 further includes a switchback mechanism 40 that, at the time of printing the two sides of the sheet 14, switches back the sheet 14 one side of which has been printed and sends the sheet 14 to the feed path 20. In this exemplary embodiment, the switchback mechanism 40 includes the branch path 24, the branching mechanism 36, and the branching roller pair 37. The branching mechanism 36 is made up of, for example, a flap or the like, and is capable of guiding to the branch path 24 the sheet 14 transported along the discharge path 25 and guiding to the third feed path 23 the sheet 14 transported along the branch path 24. That is, the sheet 14 one side of which has been printed by the printing unit 18 is guided to the branch path 24 branching from the discharge path 25 by the branching mechanism 36. After being taken in the branch path 24, the sheet 14 is reversely transported along the branch path 24 by the branching roller pair 37 being reversely rotated and is guided to the third feed path 23 by the branching mechanism 36. In short, the branching roller pair 37 switches back the sheet 14 in the branch path 24. After being switched back by the switchback mechanism 40, the sheet 14 is transported along the third feed path 23, without going via the location that faces the printing unit 18, so as to assume a posture in which the printed surface faces the gravitational direction −Z side. That is, the sheet 14 to be subjected to two-side printing is inverted in posture in the vertical direction Z after being printed on one side and then is transported to the printing unit 18 again.

The correction roller pair 35 provided in a downstream portion of the feed path 20 includes a correction driving roller (first roller) 61 and a correction driven roller (second roller) 62 that are provided side by side in the vertical direction Z. The correction driving roller 61 is provided at a location on the side opposite to the printing unit 18 across the feed path 20, that is, on the gravitational direction −Z side in the correction roller pair 35. The correction driving roller 61 is provided so as to be capable of being driven to actively rotate by the drive source (not graphically shown) such as a motor or the like. That is, the correction driving roller 61 is rotated counterclockwise in FIG. 1. On the other hand, the correction driven roller 62 is provided on the antigravitational direction +Z side in the correction roller pair 35. The correction driven roller 62 is provided so as to be capable of being passively rotated due to rotation of the correction driving roller 61. That is, the correction driven roller 62 is rotated clockwise in FIG. 1. The correction roller pair 35 transports the sheet 14 to the printing unit 18 by rotating while nipping, in the vertical direction Z, the sheet 14 transported through the feed path 20. Then, in the casing 12 there is provided a cleaning unit 63 capable of cleaning the correction driving roller 61.

Figure 2:
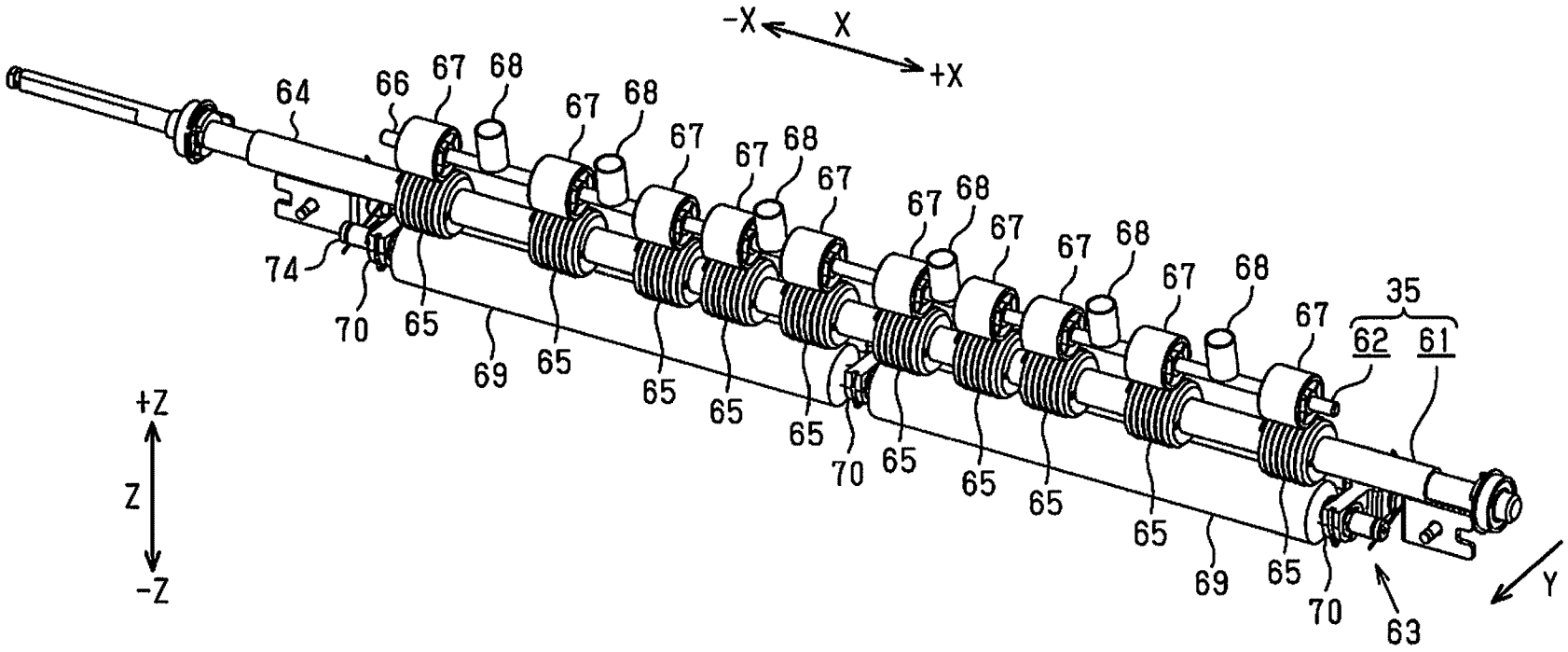
FIG. 2 is a perspective view of a correction roller pair and a cleaning unit.

As shown in FIG. 2, the correction driving roller 61, which constitutes the correction roller pair 35, includes a driving shaft 64 extending in a width direction X and a plurality of toothed rollers 65 that are inserted over the driving shaft 64. The toothed rollers 65 are fixed to the driving shaft 64 so as to be rotatable together with the driving shaft 64. In this exemplary embodiment, ten toothed rollers 65 are disposed at predetermined intervals in the width direction X. On the other hand, the correction driven roller 62, which contacts the correction driving roller 61 from the antigravitational direction +Z side, includes a driven shaft 66 extending in the width direction X and a plurality of rollers 67 that are inserted over the driven shaft 66. The rollers 67 are rotatably supported by the driven shaft 66. A total of ten rollers 67 are disposed in the width direction X so as to face the toothed rollers 65. Incidentally, the rollers 67 each have a peripheral surface that is a uniform cylindrical surface without a protuberance nor a depression and are capable of having surface contact with the transported sheet 14 while being passively rotated relative to the sheet 14 that is transported.

Furthermore, the correction driven roller 62 further has urging members 68, for example, coil springs or the like, that extend to the antigravitational direction +Z side at a plurality of locations on the driven shaft 66 different from the locations at which the rollers 67 are disposed. In this exemplary embodiment, six urging members 68 are provided at intervals in the width direction X and urge the correction driven roller 62 to the correction driving roller 61.

Figure 3:
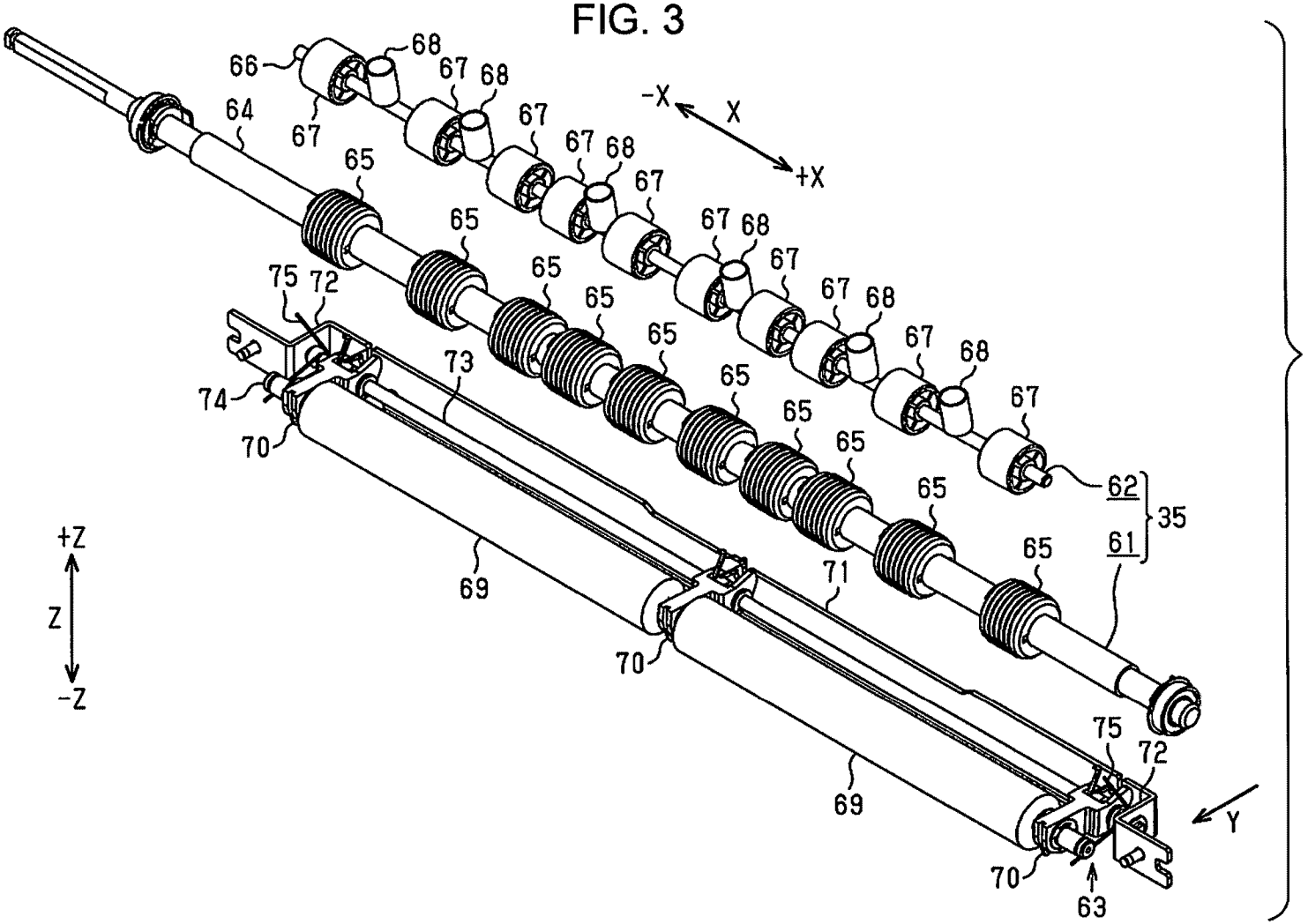
FIG. 3 is a perspective view of a correction driving roller and a correction driven roller that constitute the correction roller pair and the cleaning unit.

As shown in FIG. 2 and FIG. 3, the cleaning unit 63 is provided on the gravitational direction −Z side of the correction driving roller 61. The cleaning unit 63 includes cleaning members 69 that clean the correction driving roller 61, arm portions 70 that support the cleaning members 69, and a support plate 71 that supports the arm portions 70. The support plate 71 is a member elongated in the width direction X. Two end portions of the support plate 71 in the width direction X are each provided with a bent portion 72 that is bent to the downstream side in the transport direction Y. The support plate 71 is provided with one shaft 73 extending in the width direction X and penetrating the two bent portions 72.

The arm portions 70 are supported by the shaft 73 so as to be pivotable relative to the support plate 71. In this exemplary embodiment, a total of three arm portions 70 are provided at two end portions and a central portion of the support plate 71 in the width direction X. These arm portions 70 are each supported at their proximal end side by the shaft 73 and, at the distal end side opposite to the proximal side, are penetrated by one shaft 74 extending in the width direction X. This shaft 74 is inserted through the cylindrical cleaning members 69. The cleaning members 69 are provided between the plurality of arm portions 70 arranged in the width direction X and are supported by the arm portions 70 via the shaft 74. That is, in this exemplary embodiment, two cleaning members 69 are provided and each cleaning member 69 has its peripheral surface in contact with five toothed rollers 65 that face the cleaning member 69.

Because of the shaft 74, the cleaning members 69 are passively rotatable as the correction driving roller 61 actively rotates. That is, the cleaning members 69 are rotated clockwise in FIG. 1. Furthermore, the two arm portions 70 at both end portions of the support plate 71 in the width direction X are each provided with a coiled spring 75. These coiled springs 75 urge the distal ends of the arm portions 70 toward the correction driving roller 61. That is, the cleaning members 69 provided at the distal ends of the arm portions 70 are urged toward the toothed rollers 65.

Figure 4:
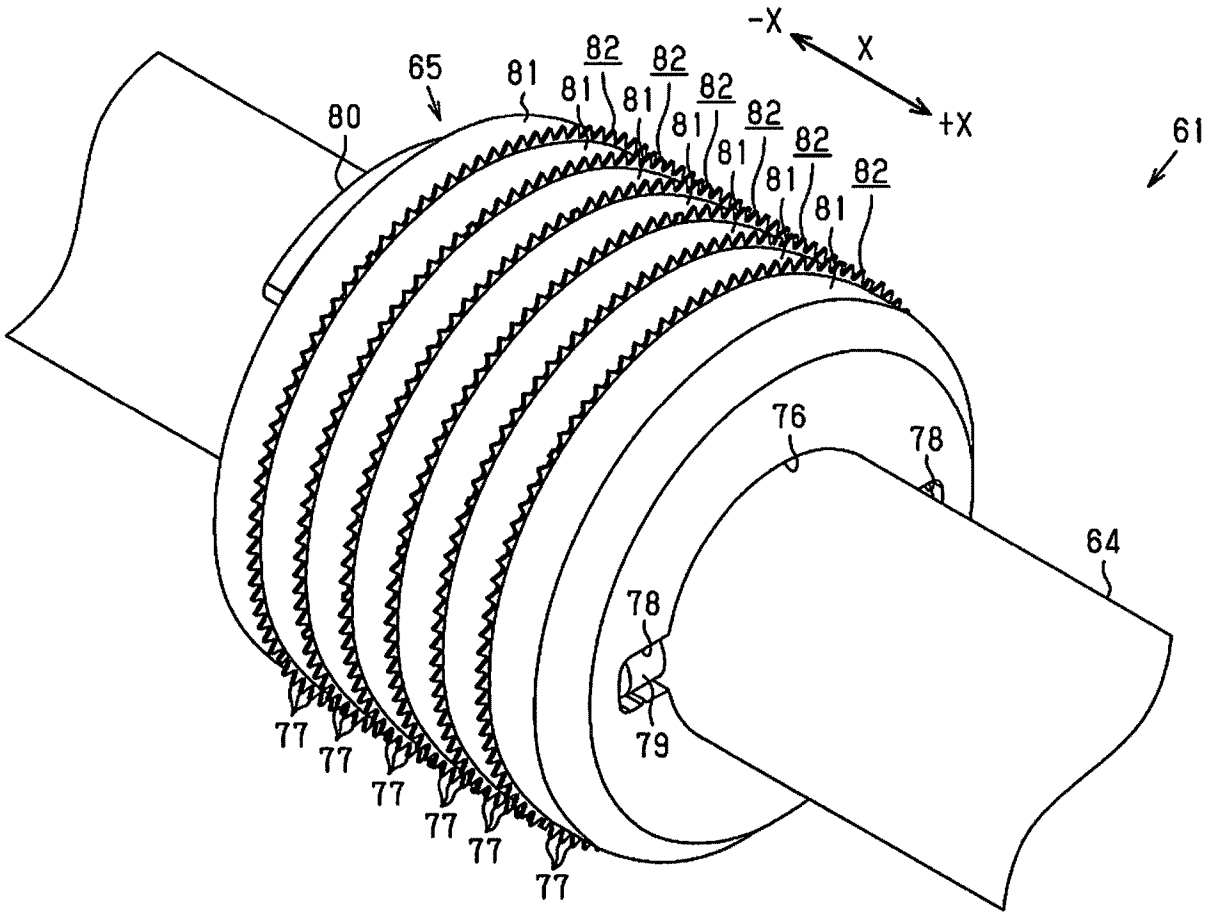
FIG. 4 is a perspective view of a toothed roller that constitutes the correction driving roller.

As shown in FIG. 4, each toothed roller 65 has a through hole 76 into which the driving shaft 64 is inserted and a plurality of teeth 77 protruded outward from the peripheral surface of the toothed roller 65. The diameter of the through hole 76 is substantially the same as the outside diameter of the driving shaft 64. The teeth 77 provided on the peripheral surface of the toothed roller 65 are arranged so as to form a plurality of rows of teeth that extend along a rotation direction of the toothed roller 65 that rotates together with the driving shaft 64, that is, a circumferential direction of the toothed roller 65, and that are juxtaposed in the width direction X. In this exemplary embodiment, six rows of teeth 77 are provided on the peripheral surface of the toothed roller 65, each row has a total of 100 teeth 77, and the six rows of teeth 77 are disposed at intervals of 2 mm in the width direction X. This toothed roller 65 transports the sheet 14 because distal ends of the teeth 77 provided on the peripheral surface contact the sheet 14. That is, the teeth 77 of the toothed roller 65 function as protruded portions capable of having point contact with the sheet 14. In other words, the correction driving roller 61 includes protruded portions capable of having point contact with the sheet 14.

Furthermore, the +X side surface of the toothed roller 65 in the width direction X has, at mutually opposite locations across the through hole 76, two rectangular hollows 78 that are sunk radially outward relative to the toothed roller 65 from an edge of the through hole 76. The driving shaft 64 inserted through the toothed roller 65 has a stopper bar 79 that restricts movement of the toothed roller 65 to the +X side in the width direction X. The stopper bar 79 extends through the driving shaft 64 in a direction that intersects with the lengthwise direction of the driving shaft 64 (intersects the width direction X). The toothed roller 65 is inserted over the driving shaft 64 in such a manner that the stopper bar 79 engages with the hollows 78. On the other hand, movement of the toothed roller 65 to the −X side is restricted by a stopper ring 80 that is fitted to the driving shaft 64. That is, because the stopper bar 79 and the stopper ring 80 stop both ends of the toothed roller 65, the toothed roller 65 is fixed on the driving shaft 64 so that its position does not shift. Furthermore, due to the hollows 78 being engaged with the stopper bar 79, the toothed roller 65 is fixed to the driving shaft 64 so as to be rotatable together with the driving shaft 64.

Figure 5:
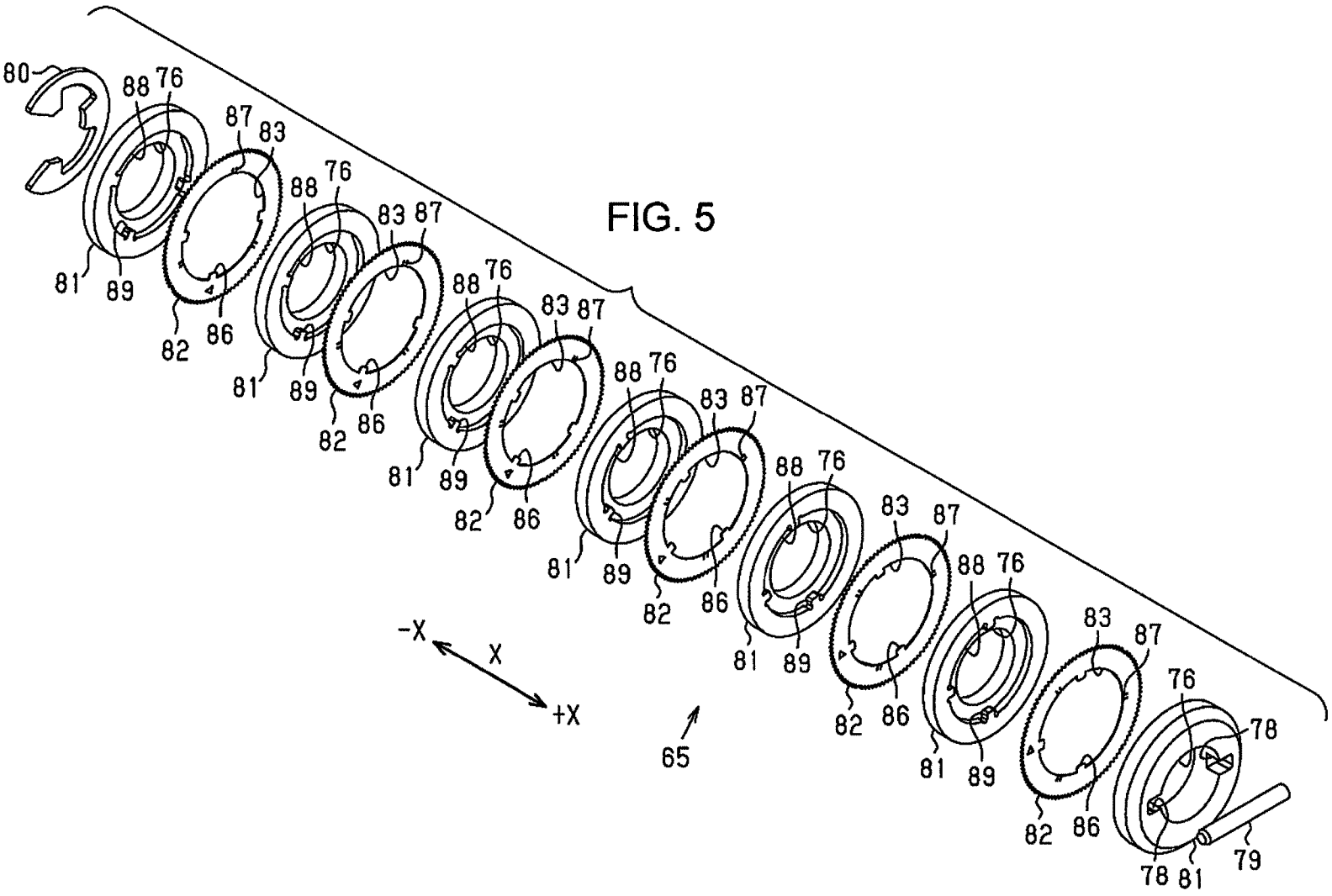
FIG. 5 is an exploded perspective view of the toothed roller that includes toothed plates and holders.
Figure 6:
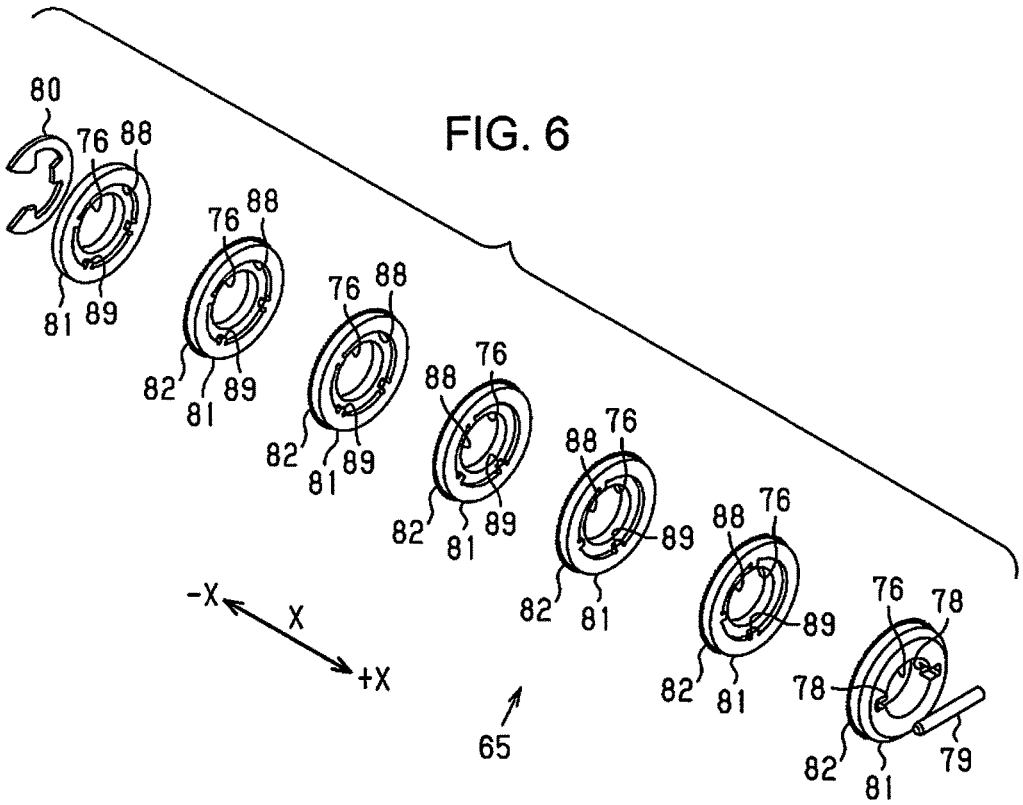
FIG. 6 is a perspective view showing a state in which the toothed plates and the holders have been superposed on each other subsequently to the state shown in FIG. 5.

As shown in FIG. 5 and FIG. 6, each of the toothed rollers 65 that constitute the correction driving roller 61 is made up of a plurality of circularly annular holders 81 and a plurality of disc-shaped toothed plates 82. In this exemplary embodiment, each toothed roller 65 is made up of seven holders 81 and six toothed plates 82 which are alternately arranged side by side in the width direction X so that each toothed plate 82 is between two holders 81. The holders 81 are each provided so as to be capable of holding a toothed plate 82. In this exemplary embodiment, each of the six holders 81 other than the holder 81 positioned at the end on the −X side in the width direction X holds an adjacent toothed plate 82 fitted to the −X side surface of that holder 81. Furthermore, of the plurality of holders 81, the holder 81 positioned at the +X side end in the width direction X has on its +X side surface the hollows 78 with which the stopper bar 79 engages. Each holder 81 has a through hole 76 into which to insert the driving shaft 64. On the other hand, each toothed plate 82 has a hole 83 that is larger in diameter than the through holes 76 of the holders 81.

Figure 7:
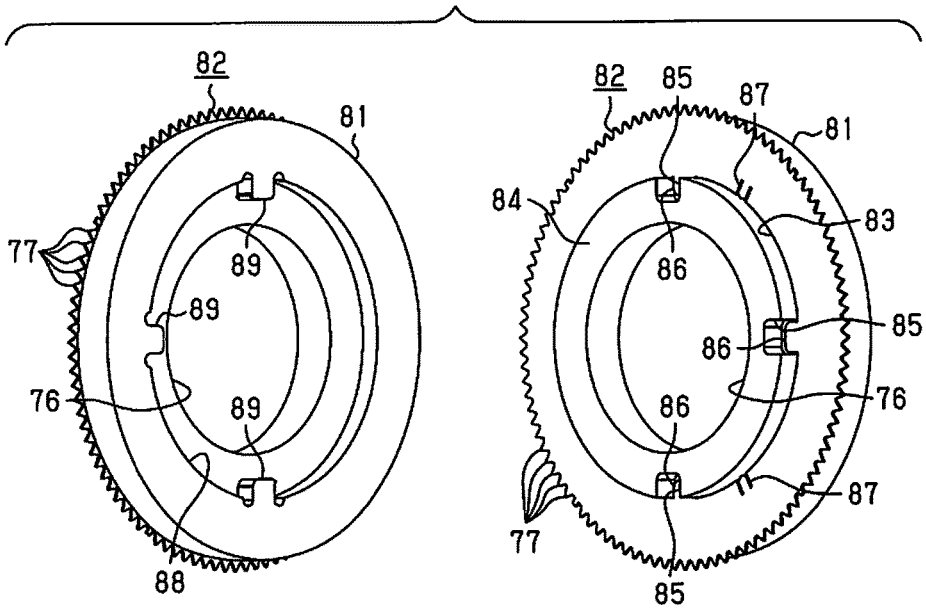
FIG. 7 is a perspective view showing holders to which toothed plates have been fitted.

As shown in FIG. 7, each of the holders 81 has on its side surface (−X side surface) to which an adjacent toothed plate 82 is fitted a circularly annular boss 84 whose outside diameter is smaller than the outside diameter of the holder 81. The boss 84 is protruded from an edge of the through hole 76. The boss 84 of each holder 81 is also penetrated by the through hole 76. The boss 84 has a plurality of pits 85 (three pits 85 in this exemplary embodiment) that are sunk radially inward relative to the holder 81 from the outer peripheral surface of the boss 84. The boss 84 of each holder 81 penetrates a hole 83 of the adjacent toothed plate 82 so that the toothed plate 82 is fitted to the holder 81.

Each toothed plate 82 has along its outer perimeter the teeth 77 that are protruded radially outward and that are contiguous to each other and also has on the edge of the hole 83 lugs 86 that extend radially inward. Furthermore, an edge portion of the hole 83 of the toothed plate 82 has at locations different from those of the lugs 86 a plurality of contact pieces 87 that are formed by cutting so as to point radially inward from the edge portion of the hole 83. The diameter of the hole 83 of each toothed plate 82 is substantially the same as the outside diameter of the boss 84 of each holder 81. Each toothed plate 82 is fitted to an adjacent holder 81, with the lugs 86 of the toothed plate 82 engaged with the pits 85 of the boss 84 of the holder 81. Thus, the toothed plates 82 are attached to the holders 81 so as to be rotatable together with the holders 81. Note that the contact pieces 87 of each toothed plate 82 that is pressingly fittable to the holder 81 is provided in order to restrain the wobbliness of the toothed plate 82 when the toothed plate 82 is pressing fitted to the holder 81 and therefore to improve the accuracy in coaxiality with respect to the holder 81.

As shown in FIG. 5, FIG. 6, and FIG. 7, each of the six holders 81 other than the holder 81 that is located at the +X side end in the width direction X has on its +X side surface a circular hollow portion 88 sunk toward the −X side. Similar to the boss 84, the hollow portion 88 of each of the six holders 81 has the through hole 76. The hollow portion 88 of each holder 81 is fittable to the boss 84 of an adjacent holder 81. That is, the diameter of the hollow portion 88 is substantially the same as the outside diameter of the boss 84. Furthermore, corresponding to the pits 85 formed on the boss 84, a plurality of engagement protrusions 89 are protruded from an inner peripheral surface of the hollow portion 88 to a radially inward. Adjacent holders 81 are coupled by fitting the boss 84 and the hollow portion 88 thereof. Furthermore, the holders 81 are coupled so as to be rotatable together as the pits 85 engages with the engagement protrusions 89.

That is, each toothed roller 65 is made by coupling adjacent holders 81 with toothed plates 82 interposed therebetween. Therefore, the teeth 77 provided on the peripheral surface of the toothed roller 65 are made up of those of the toothed plates 82 and the peripheral surface of the toothed roller 65 is made up of the peripheral surfaces of the holders 81.

Figure 8:
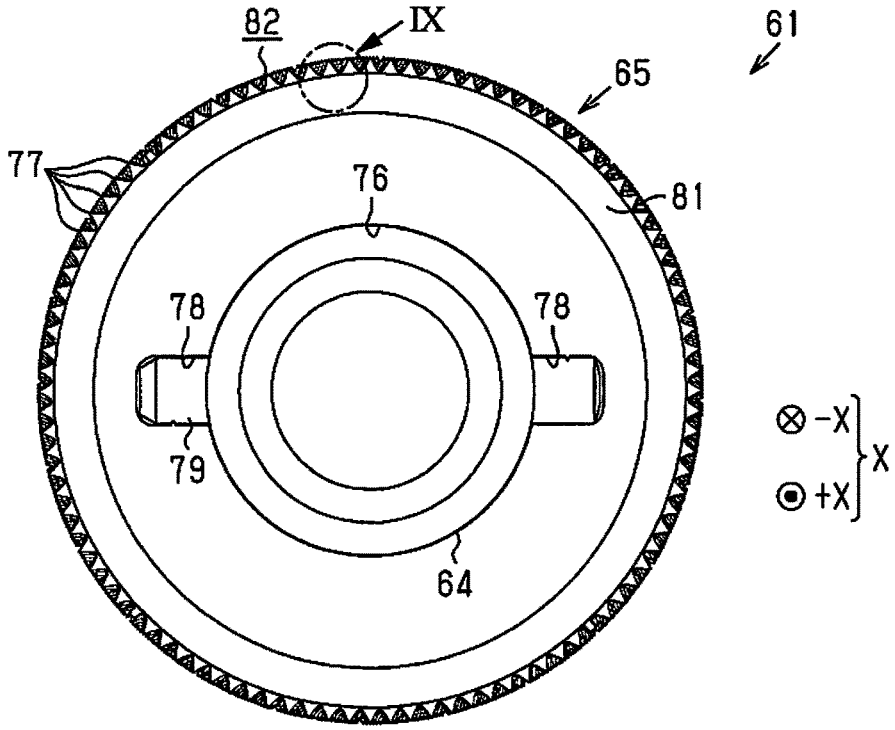
FIG. 8 is a side view of the toothed roller viewed from a width direction.
Figure 9:
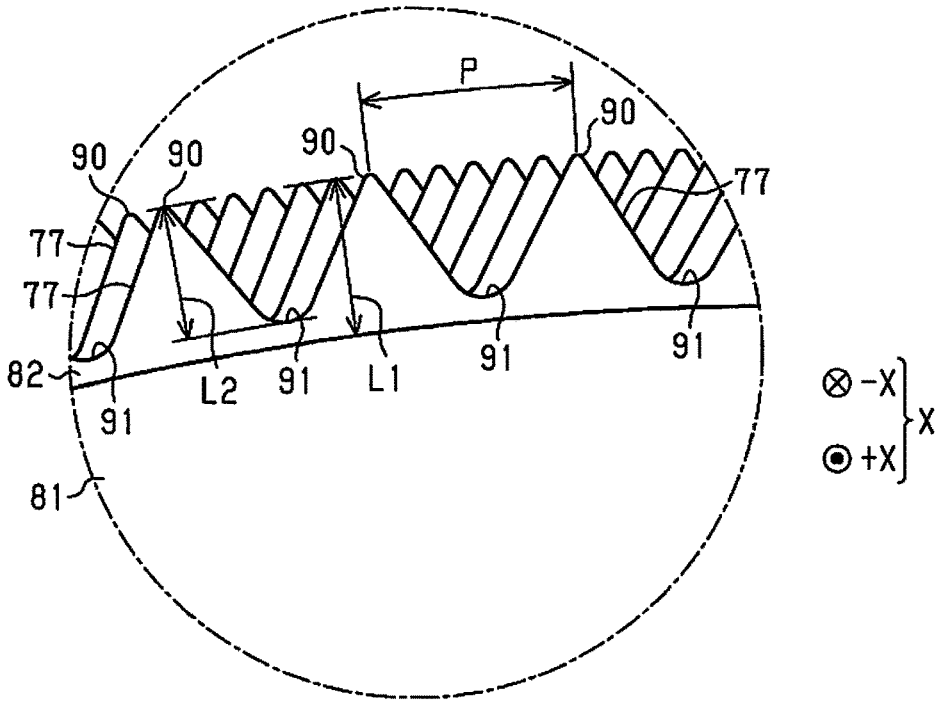
FIG. 9 is an enlarged view of a portion IX indicated in FIG. 8.

As shown in FIGS. 8 and 9, in each toothed roller 65 made up by superposing the holders 81 and the toothed plates 82 in the width direction X, the teeth 77 of the toothed plates 82 are shifted from each other in the position on the peripheral surface of the toothed roller 65 so that the teeth are not perfectly superposed over each other when viewed from the width direction X. Specifically, the teeth 77 provided on the peripheral surface of each toothed roller 65 are disposed so that all the teeth 77 are visible when viewed from the width direction X. In this exemplary embodiment, the teeth 77 are disposed so that, when viewed from the width direction X, the intervals between the teeth 77 in the circumferential direction of the toothed roller 65 are equal. Specifically, the six toothed plates 82 are disposed so that, when viewed from the width direction X, one pitch P between teeth 77 of one toothed plate 82 is divided into six equal parts by adjacent teeth 77 of the other five toothed plates 82. In this exemplary embodiment, the pitch P between the teeth 77 is 0.6 mm long.

Each toothed plate 82 has peak portions 90 of the teeth 77 that are distal ends thereof and groove-shaped trough portions 91 between the peak portions 90. These trough portions 91 are provided at positions that are radially outward of the peripheral surfaces of the holders 81 in the radial direction of the toothed roller 65. Incidentally, in this exemplary embodiment, the distance L1 from the peripheral surface of the holders 81 to the peak portions 90 of the teeth 77 in the radial direction of the toothed rollers 65 is 0.48 mm and the distance L2 from the trough portions 91 to the peak portions 90 of the teeth 77 in the radial direction is 0.41 mm. Furthermore, it is preferable that the teeth 77 that make point contact with the sheet 14 have a triangular shape with its vertex angle being 45 degrees or more. In this exemplary embodiment, the angle of each peak portion 90 is 60 degrees.

Figure 10:
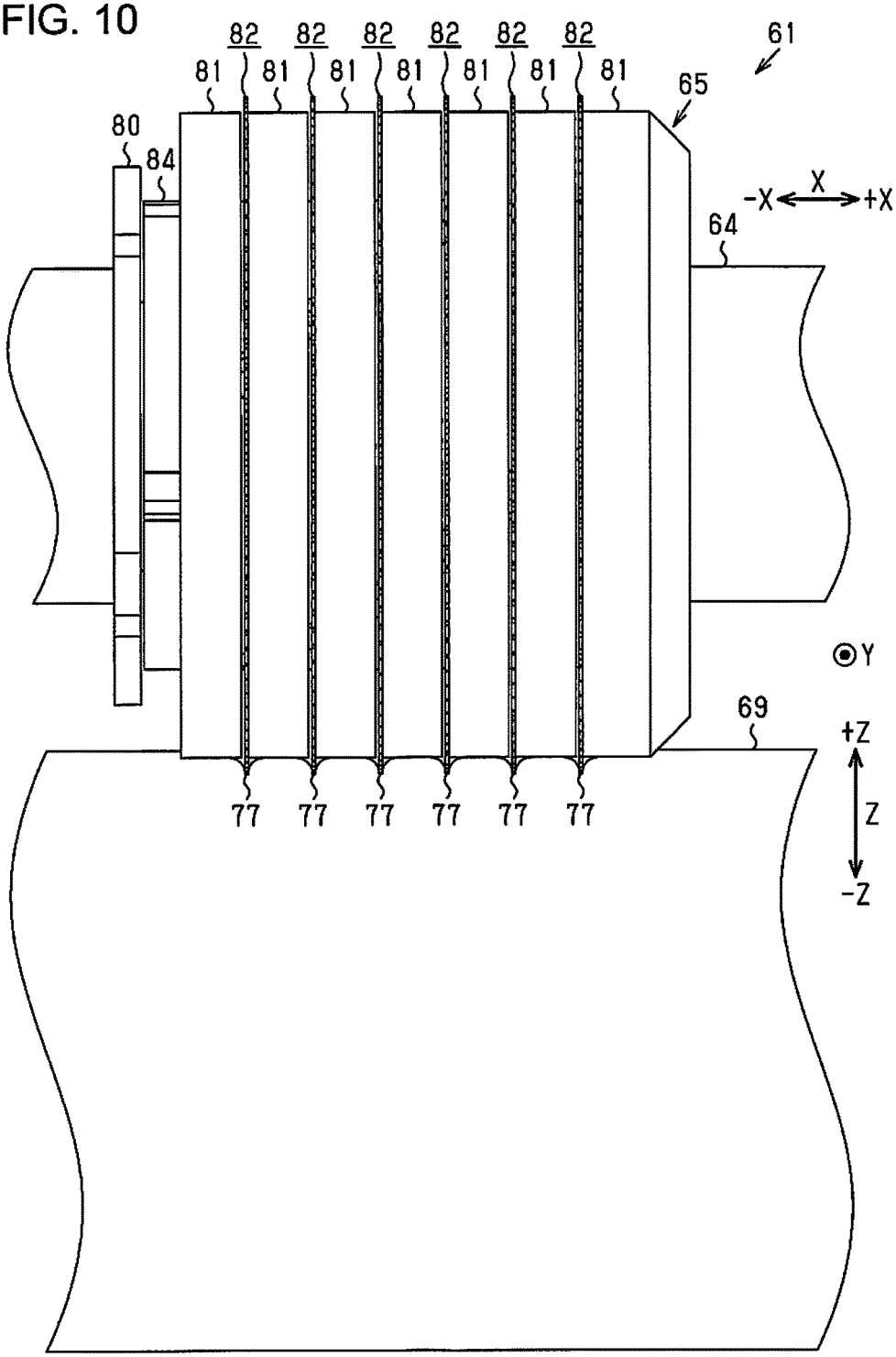
FIG. 10 is a front view of the correction driving roller and the cleaning member viewed from a downstream side in a transport direction.

As shown in FIG. 10, the toothed rollers 65 that constitute the correction driving roller 61 are contacted by the cleaning members 69 from the gravitational direction −Z side in the vertical direction Z. The cleaning members 69 that are urged to the toothed rollers 65 are made of a material (e.g., a foam) that is excellent in flexibility and water retentivity, for example, foamed plastic or the like, and are capable of wiping off the ink adhering to the toothed rollers 65. In this exemplary embodiment, the cleaning members 69 are each made up of a foam roller made of urethane foam and have a pore size of 10 to 30 μm, a porosity of 75 to 90%, and a water retention rate of 300 to 400%. Incidentally, the water retention rate is the rate of increase in weight which occurs when a material in a dry state is soaked with water to a saturated state, and can be mathematically expressed as (the water retention rate)=[{(the sample's weight in the water saturated state)−(the sample's weight in the dry state)}/{(the sample's weight in the dry state)}×100]. These cleaning members 69 are in contact with the distal ends of teeth 77 that are arranged on the peripheral surfaces of the toothed rollers 65 in the rotation direction of the correction driving roller 61 in such a contact manner that the distal ends of the teeth 77 are sunk into the peripheral surfaces of the cleaning members 69. Furthermore, the cleaning members 69 are in contact with not only teeth 77 of the toothed rollers 65 but also the peripheral surfaces of the holders 81 of the toothed rollers 65. That is, the cleaning members 69 clean the correction driving roller 61 by contacting the teeth 77 and the peripheral surfaces of the correction driving roller 61.

Figure 11:
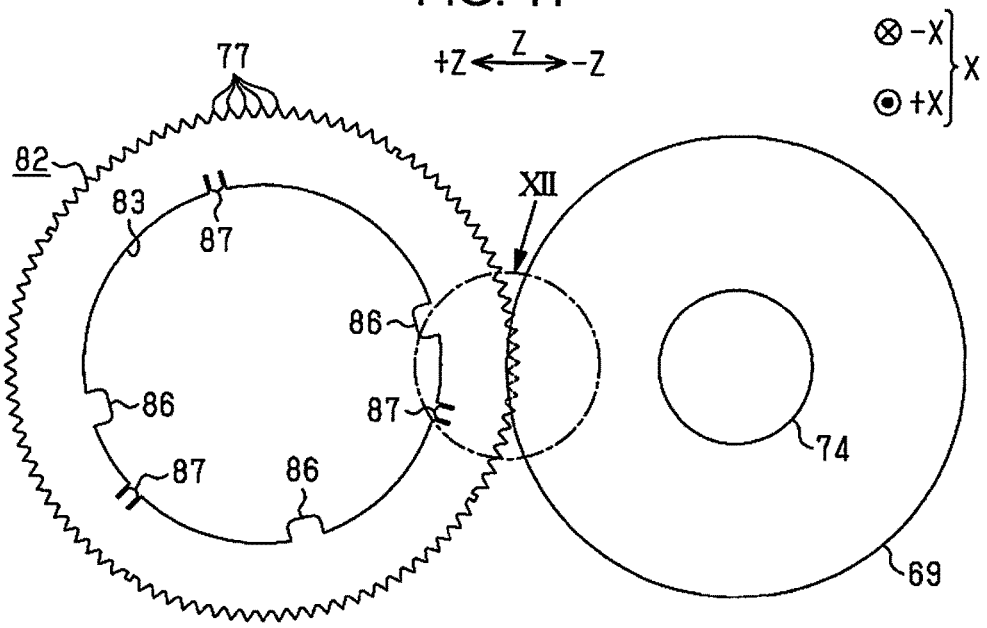
FIG. 11 is a schematic diagram showing a positional relation between the toothed plates and the cleaning member in a vertical direction.
Figure 12:
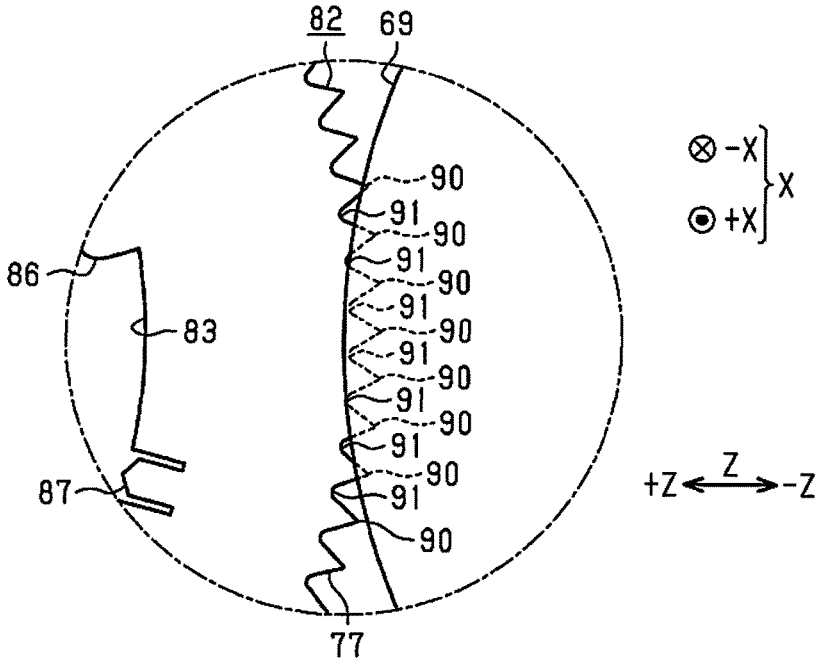
FIG. 12 is an enlarged view of a portion XII indicated in FIG. 11.

As shown in FIGS. 11 and 12, if a cleaning member 69 and a toothed plate 82 extracted from a toothed roller 65 in contact with the cleaning member 69 were viewed in the width direction X, a portion of the peripheral surface of the cleaning member 69 would be seen to be radially inward, relative to the toothed plate 82, from the trough portions 91 of teeth 77 of the toothed plate 82. That is, the cleaning members 69 have an overlapping positional relation with the toothed plates 82 such that, when viewed from the width direction X, the peripheral surfaces of the cleaning members 69 partially lie more radially inward, with respect to the toothed plates 82, than the trough portions 91 of teeth 77 of the toothed plates 82.

Next, operation of the printer 11 constructed as described above, with a particular focus on the correction roller pair 35, will be described.

Figure 13:
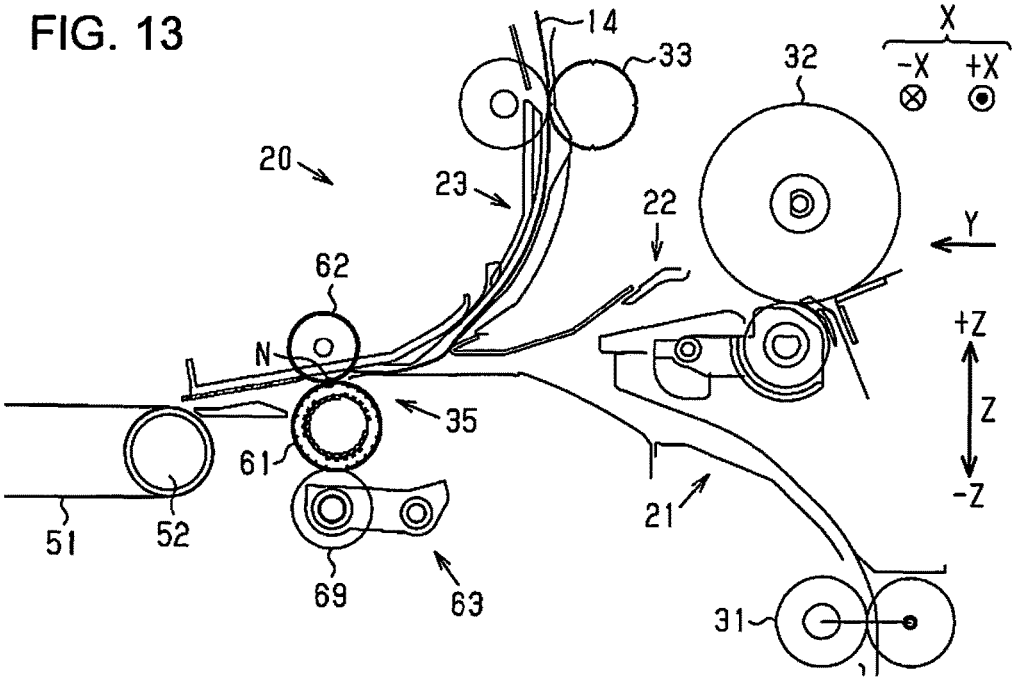
FIG. 13 is a schematic side view showing a state in which a leading end of a sheet being transported along a third feed path has come into firm contact with the correction driven roller that constitutes the correction roller pair.

As shown in FIG. 13, the sheet 14 to be subjected to two-side printing, after the printing unit 18 has printed on one side, is switched back by the switchback mechanism 40 and is transported through the third feed path 23. Because of being transported through the third feed path 23, the sheet 14 assumes a posture such that the printed surface thereof faces the gravitational direction −Z side. Due to the third feed roller pair 33, the sheet 14 passes through the meeting point of the first to third feed paths 21, 22 and 23 and is transported to the correction roller pair 35 disposed at a downstream side in the feed path 20. The leading end of the sheet 14 is caused to have firm contact with the correction roller pair 35 that has been stopped rotating. Note that since the correction roller pair 35 is disposed so that, when viewed from the width direction X, the correction driven roller 62 of the correction roller pair 35 hangs over the feed path 20. Therefore, the leading end of the sheet 14 transported through the feed path 20 first contacts the correction driven roller 62.

Figure 14:
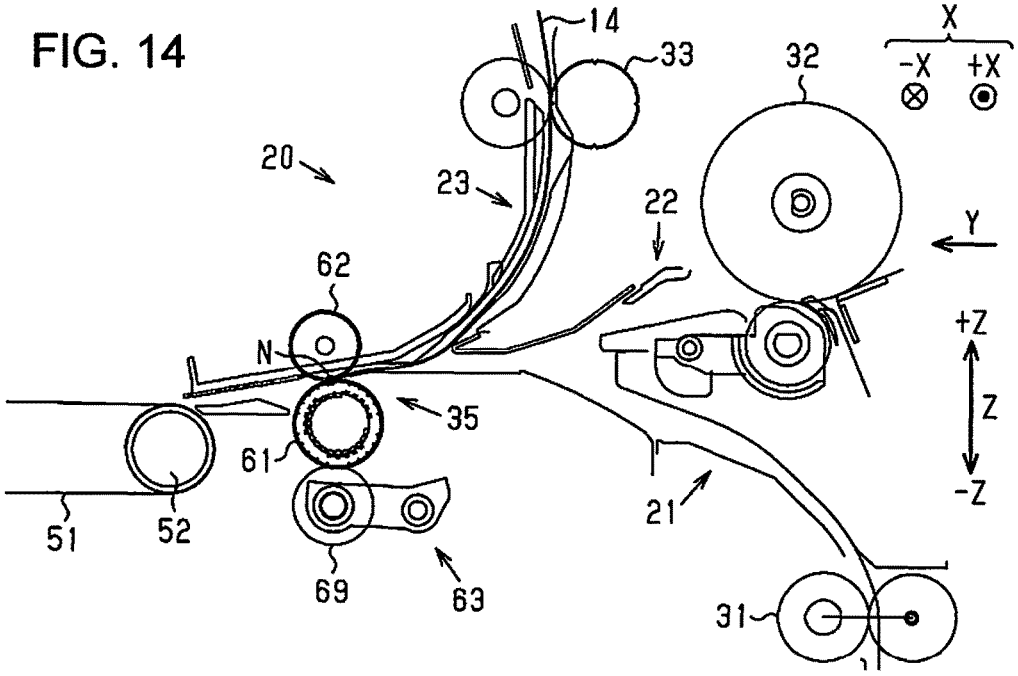
FIG. 14 is a schematic side view showing a state in which the leading end of the sheet being transported along the third feed path has been guided to a nipping position on the correction roller pair.

As shown in FIG. 14, after the sheet 14 has come into contact with the peripheral surface of the correction driven roller 62, the leading end thereof is guided to the downstream side in the transport direction Y along the peripheral surface of the correction driven roller 62. Thus, the leading end of the sheet 14 is guided to an inserting position at which the sheet 14 is inserted between the correction driving roller 61 and the correction driven roller 62, that is, to a nipping position N on the correction roller pair 35. That is, the peripheral surface of the correction driven roller 62 functions as a guide surface that guides the leading end of the sheet 14 to the nipping position N on the correction roller pair 35. Note that the peripheral surface of the correction driven roller 62 is a uniform cylindrical surface without a protuberance nor a depression which is capable of having surface contact with the sheet 14, so that the risk of the leading end of the sheet 14 being caught on the peripheral surface of the correction driven roller 62 is small. Then, after the leading end of the sheet 14 is guided to the peripheral surface of the correction driven roller 62, the sheet 14 is sent out by rotation of the third feed roller pair 33 and then the leading end of the sheet 14 is caused to have firm contact with a nipping site that is the nipping position N on the correction roller pair 35.

Figure 15:
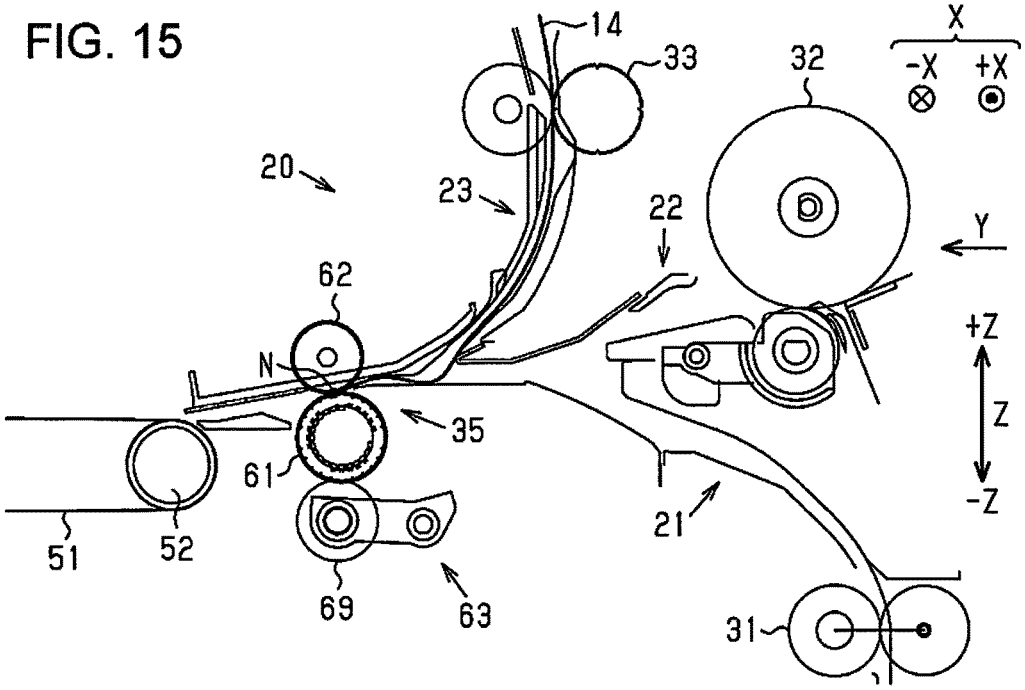
FIG. 15 is a schematic side view showing a state in which the sheet being transported along the third feed path is subjected to skew correction by the correction roller pair.

As shown in FIG. 15, after being caused to have firm contact with the nipping site that is the nipping position N on the correction roller pair 35, a portion of the sheet 14 between the leading end and a proximal end thereof bends in a waving fashion in the transport direction Y within the feed path 20 as the third feed roller pair 33 continues to rotate. Because the sheet 14 bends while being forced in firm contact with the nipping site, a portion of the sheet 14 between the leading end and a proximal end-side portion is pivoted about a fulcrum at the contact position between the sheet 14 and the correction roller pair 35. Because the portion of the sheet 14 extending from the leading end to the proximal end side pivots, the leading end of the sheet 14 is appropriately placed at the nipping position N on the correction roller pair 35 elongated in the width direction X, so that obliqueness of the sheet 14 relative to the transport direction Y, that is, skew thereof, is corrected.

Figure 16:
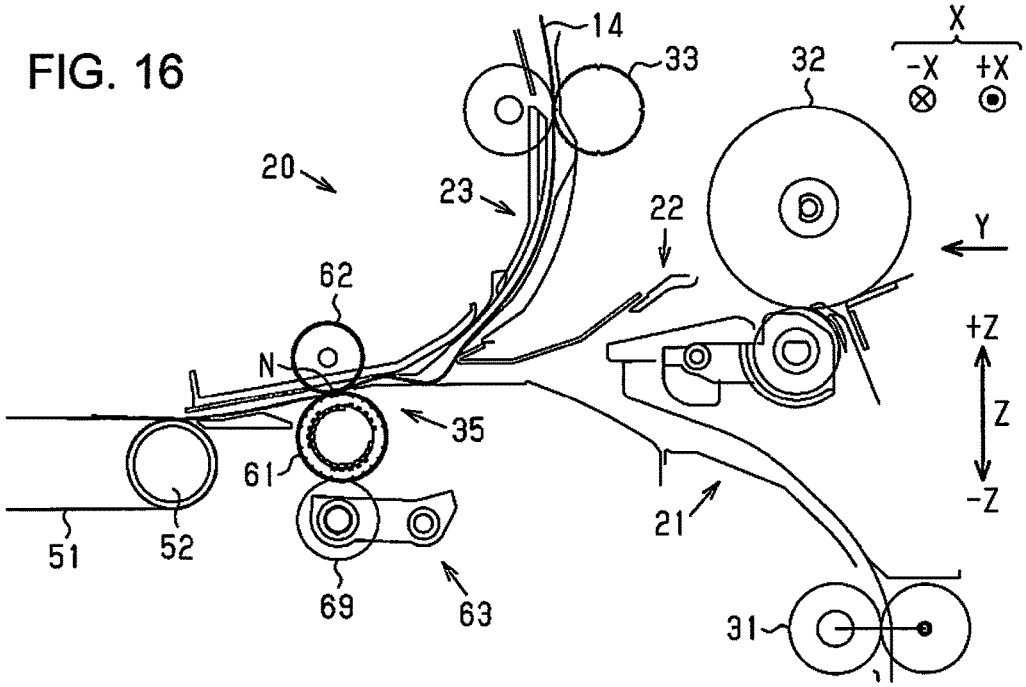
FIG. 16 is a schematic side view showing a state in which the sheet being transported along the third feed path is transported toward a printing unit after having been subjected to the skew correction by the correction roller pair.

As shown in FIG. 16, after the leading end of the sheet 14 is adjusted to the nipping position N on the correction roller pair 35, the correction roller pair 35 having been stopped starts rotating, so that the sheet 14, while being kept in a state in which obliqueness has been corrected, is nipped by the correction roller pair 35 and is transported toward the printing unit 18. Furthermore, also when the sheet 14 is transported through the first and second feed paths 21 and 22, the leading end of the sheet 14 is guided to the nipping position N on the correction roller pair 35 by the peripheral surface of the correction driven roller 62 so as to have firm contact with the correction roller pair 35 at the nipping position N, whereby skew is corrected.

The correction roller pair 35 is usually constructed so as to have a stronger force of nipping the sheet 14 than other roller pairs in order to prevent the leading end of the sheet 14 from passing the nipping position N when the leading end of the sheet 14 is caused to have firm contact with the correction roller pair 35 in order to correct the skew of the sheet 14. That is, the correction roller pair 35, when transporting the sheet 14 that is to be subjected to the two-side printing, strongly nips the sheet 14. Therefore, it is conceivable that, when the printed surface of the sheet 14 having subjected to the printing of the one side contacts the correction driving roller 61, ink adheres to the correction driving roller 61. If ink adheres to the correction driving roller 61, there is a possibility that the next sheet 14 to be transported through the feed path 20 toward the printing unit 18 will be stained when the sheet 14 is nipped by the correction roller pair 35.

In particular, in this exemplary embodiment, the ink that the printing unit 18 discharges is a water-based ink and the water-based ink takes a longer time to dry than the oil-based whose solvent is an organic solvent or the like. Therefore, depending on the amount of ink discharged onto one side of the sheet 14, it sometimes happens that the ink does not dry out before the sheet 14 arrives at the correction roller pair 35 again. That is, in the printer 11 that uses the water-based ink as in this exemplary embodiment, the adhesion of the ink to the correction driving roller 61 usually becomes conspicuous. However, because the correction roller pair 35 in this exemplary embodiment is constructed so that the correction driving roller 61 that contacts the printed surface of the sheet 14 at the time of the two-side printing of the sheet 14 is capable of having point contact with the sheet 14, the risk of the adhesion of ink is reduced.

Furthermore, should ink adheres to the correction driving roller 61, the correction driving roller 61 is cleaned by the cleaning members 69 that are passively rotated as the correction driving roller 61 rotates. At this time, the cleaning members 69 contact not only the teeth 77 of the toothed rollers 65 that constitute the correction driving roller 61 but also the peripheral surfaces of the toothed rollers 65. Note that when the correction driving roller 61 rotates, the circumferential speed of the peripheral surface thereof is lower than the circumferential speed of the distal end portions (peak portions 90) of the teeth 77. Therefore, since the cleaning members 69 are in contact with the peripheral surface of the correction driving roller 61, the friction therebetween causes the cleaning members 69 to be passively rotated at a circumferential speed that is lower than the circumferential speed of the distal end portions (peak portions 90) of the teeth 77 of the correction driving roller 61.

The foregoing exemplary embodiment can achieve advantageous effects as follows.

(1) When the sheet 14 to be subjected to two-side printing is transported again to the printing unit 18 after being switched back, the sheet 14 is transported as the correction driving roller 61 that constitutes the correction roller pair 35 contacts the printed surface of the sheet 14 which has already been printed. Note that since the correction driving roller 61 of the correction roller pair 35 has on its peripheral surface the teeth 77 that have point contact with the printed surface of the sheet 14, the correction driving roller 61 in this exemplary embodiment achieves reduced areas of contact with the printed surface of the sheet 14 in comparison with a correction driving roller that has surface contact with a printed surface. Therefore, the risk of ink adhering to the correction driving roller 61 via the printed surface of the sheet 14 is reduced. Specifically, the risk of ink being transferred from a sheet 14 to the next sheet 14 via the correction driving roller 61 is reduced. Therefore, the risk that the correction roller pair 35 for correcting skew of the sheet 14 may stain the sheet 14 can be reduced.

(2) The risk that the leading end of a sheet 14 that has firm contact with the correction roller pair 35 may move into a space between teeth 77 of the correction driving roller 61 is reduced in comparison with a construction in which the teeth 77 on the peripheral surface of a correction driving roller 61 are aligned in a row in the width direction X. That is, the skew of the medium by the correction roller pair 35 can be accurately corrected.

(3) The correction roller pair 35 in this exemplary embodiment can accurately transport the sheet 14 in comparison with a construction in which a correction driving roller 61 capable of having point contact with the sheet 14 is passively rotated.

(4) At the time of the two-side printing of a sheet 14, the sheet 14 is not switched back in the discharge path 25 after one side of the sheet 14 has been printed. Therefore, the sheet 14 being subjected to the two-side printing does not occupy the discharge path 25. Therefore, while a sheet 14 is being switched back in the branch path 24, the next sheet 14 transported along the feed path 20 to the printing unit 18 can be printed. This allows the printer 11 to be improved in the processing capability.

(5) For example, in a construction in which a sheet 14 is guided toward the inserting position to insert the sheet 14 between the correction roller pair 35, that is, the nipping position N on the correction roller pair 35, by the peripheral surface of the correction driving roller 61, the correction driving roller 61, which is provided with the teeth 77 capable of having point contact with the sheet 14, poses a risk that the leading end of the sheet 14 may become caught on the peripheral surface of the correction driving roller 61 and therefore the sheet 14 cannot be appropriately guided to the nipping position N for the sheet 14 with respect to the correction roller pair 35. However, in the printer 11 of this exemplary embodiment, the peripheral surface of the correction driven roller 62 capable of having surface contact with the sheet 14 contacts the sheet 14, so that the sheet 14 can be appropriately guided to the inserting position for the sheet 14 with respect to the correction roller pair 35.

(6) Due to the toothed rollers 65, the correction driving roller 61 capable of having point contact with the sheet 14 can be easily constructed.

(7) Even when ink adheres to the teeth 77 of the correction driving roller 61 during transportation of the sheet 14, the teeth 77 can be cleaned by the cleaning members 69. Thus, the risk of the correction roller pair 35 staining the sheet 14 can be reduced.

(8) Since the cleaning members 69 are passively rotated corresponding to the active rotation of the correction driving roller 61, the endurance of the cleaning members 69 can be improved in comparison with a construction in which cleaning members 69 are caused to actively rotate.

(9) As can be understood when rotations of the correction driving roller 61 and the cleaning members 69 are viewed relative to each other, the correction driving roller 61 rotates relative to the cleaning members 69 so that the teeth 77 are wiped by the cleaning members 69 because of the circumferential speed difference. This improves the cleaning effect of the cleaning members 69.

(10) Since the foam rollers that function as the cleaning members 69 are excellent in water retentivity, the cleaning members 69 can continue to be used over a long period of time.

(11) The cleaning members 69 are urged by the coiled spring 75 to always remain in contact with the correction driving roller 61. Therefore, should ink be transferred to the correction driving roller 61, the correction driving roller 61 can be immediately cleaned. This reduces the risk of ink accumulating on or becoming fixed to the peripheral surface of the correction driving roller 61.

(12) In the correction roller pair 35, since the correction driving roller 61 capable of having point contact with the sheet 14 actively rotates, the sheet 14 can be appropriately transported although the area of contact with the sheet 14 is small.

The foregoing exemplary embodiment can be modified as follows.

Figure 17:
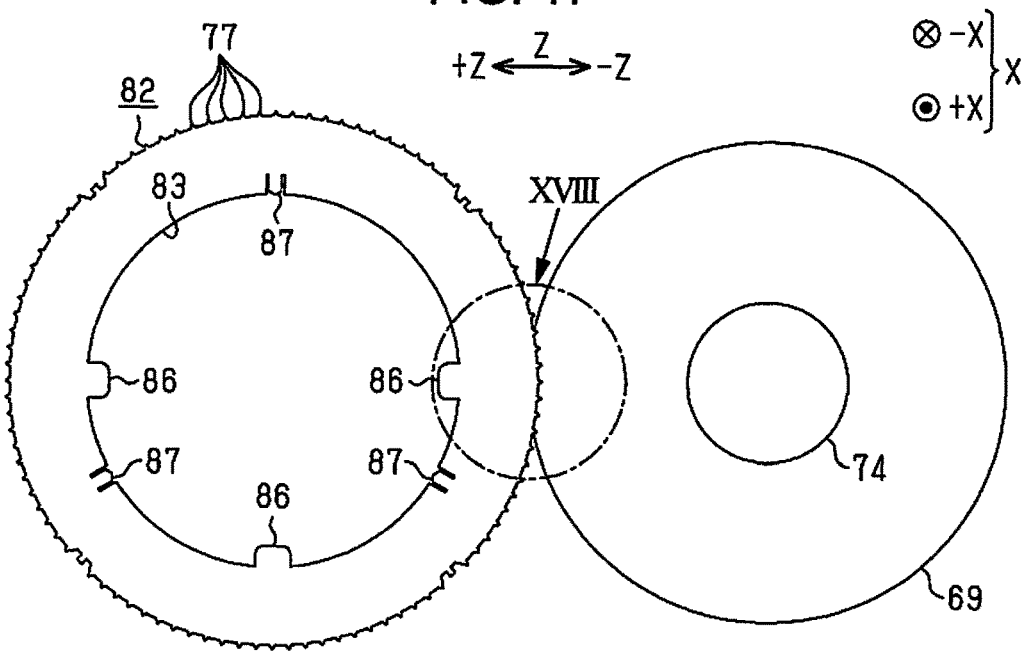
FIG. 17 is a schematic side view showing a state in which the cleaning has come into contact with a toothed plate according a modification of the exemplary embodiment.
Figure 18:
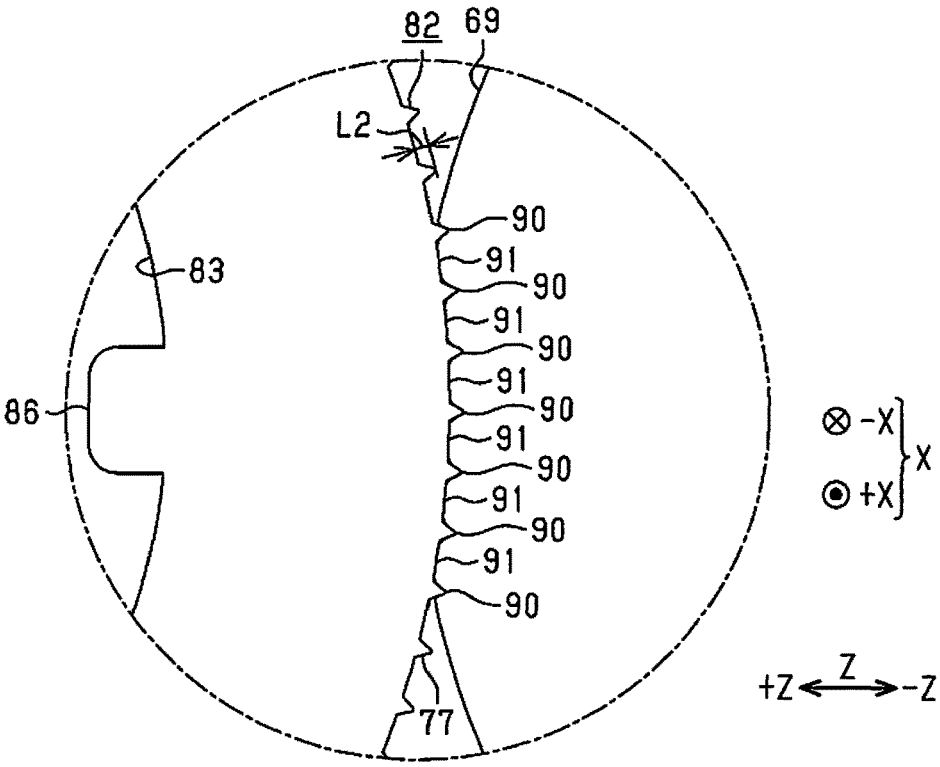
FIG. 18 is an enlarged view of a portion XVIII indicated in FIG. 17.

As shown in FIGS. 17 and 18, in the exemplary embodiment, the toothed plates 82 that constitute each toothed roller 65 may each be formed so that the trough portions 91 of the teeth 77 as well as the peak portions 90 thereof can contact the cleaning member 69. As shown in FIG. 18, in the toothed plates 82 of this modification, the trough portions 91 of the teeth 77 have been raised in level so that the distance L2 between each trough portion 91 and an adjacent peak portion 90 is shorter than in the toothed plates 82 of the exemplary embodiment shown in FIGS. 8 and 9. Concretely, in the exemplary embodiment shown in FIGS. 8 and 9, the distance L2 between the trough portions 91 from the peak portions 90 of the teeth 77 of the toothed rollers 65 is 0.41 mm whereas in the modification shown in FIGS. 17 and 18, the distance L2 from the trough portions 91 to the peak portions 90 of the teeth 77 of each toothed plate 82 is 0.15 mm. Note that the distance L1 from the peripheral surfaces of the holders 81 to the peak portions 90 of the teeth 77 is 0.48 mm in both the constructions.

Figure 19:
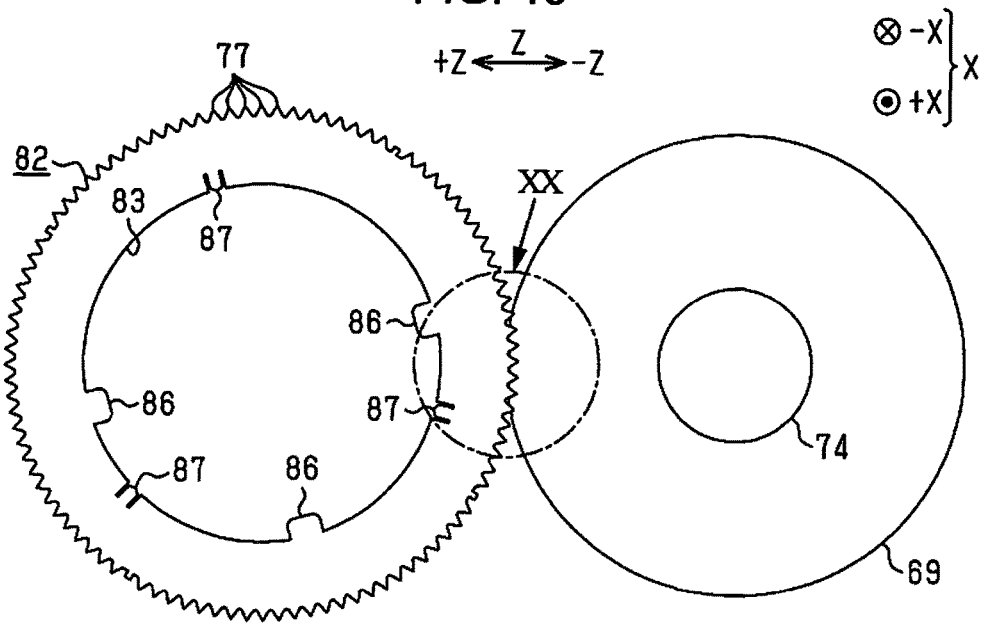
FIG. 19 is a schematic diagram showing a positional state of a peripheral surface of the cleaning member in relation to peak portions and trough portions of teeth of the toothed plate when the cleaning member is in contact with the toothed plate in this exemplary embodiment.
Figure 20:
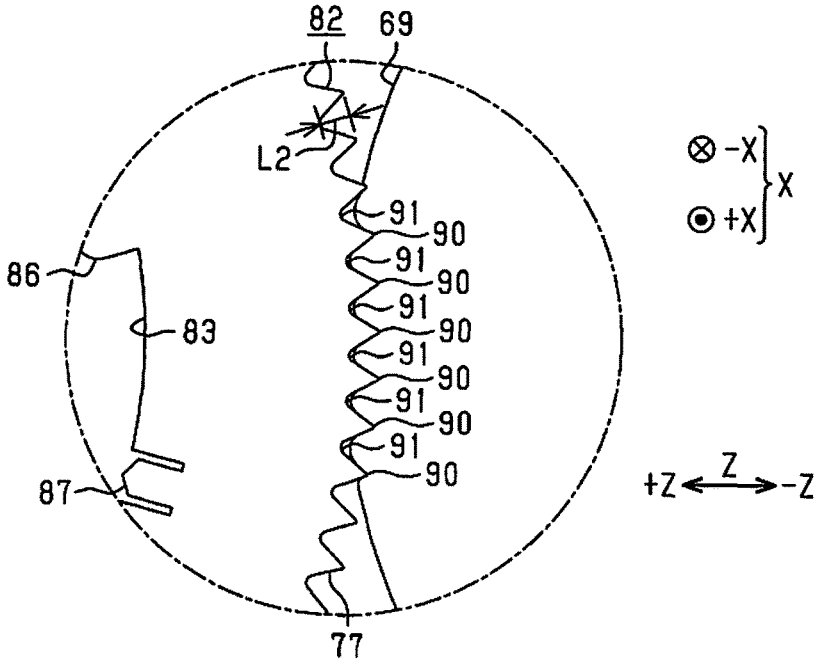
FIG. 20 is an enlarged view of a portion XX indicated in FIG. 19.

As shown in FIGS. 19 and 20, as for the toothed plates 82 in the exemplary embodiment, the relatively long distance L2 between the peak portions 90 and the trough portions 91 of the teeth 77 sometimes prevents the cleaning members 69 from reaching the trough portions 91 despite the biting contact of the teeth 77. That is, the foregoing modification can achieve advantageous effects as follows, in addition to the foregoing advantageous effects of the exemplary embodiment.

(13) Even when ink gets in between teeth 77 of the correction driving roller 61, the ink can be removed by the cleaning members 69.

Furthermore, a measure to realize a construction in which the cleaning members 69 contact the trough portions 91 of the teeth 77 may be changing the length of the pitch P of the teeth 77 or may also be forming the cleaning members 69 from a material that is more excellent in flexibility. Furthermore, the foregoing construction may be realized by changing the shape of the teeth 77 or may also be realized by, for example, providing protuberances and depressions on the peripheral surfaces of the cleaning members 69. Realizing such a construction involves various parameters, including the shape, flexibility, and outside diameter of the cleaning members 69, the force by which the arm portions 70 urge the cleaning members 69 to the toothed rollers 65, the shape of the teeth 77 of the toothed plates 82, the length of the pitch P of the teeth 77, the amount of protrusion of the teeth 77, etc.

Figure 21:
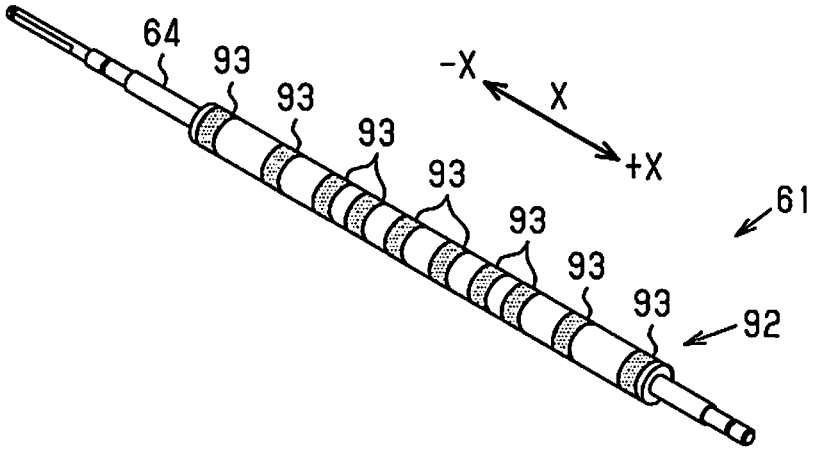
FIG. 21 is a perspective view of a non-slip roller that is a modification of the correction driving roller.
Figure 22:
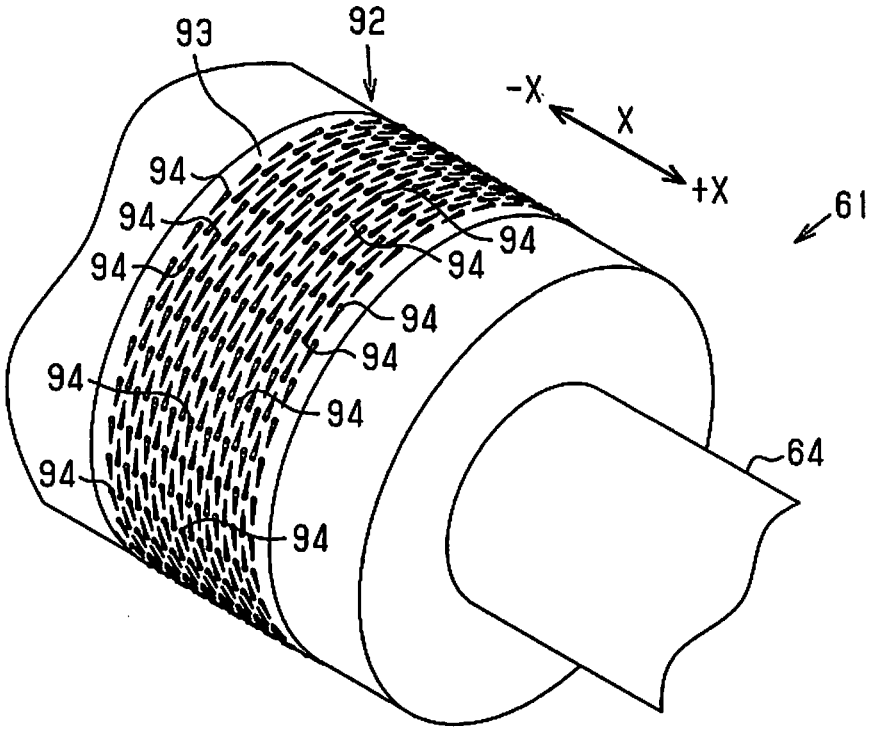
FIG. 22 is an enlarged view of a portion of the non-slip roller.

As shown in FIGS. 21 and 22, in the foregoing exemplary embodiment, the correction driving roller 61 may be made up of a so-called non-slip roller 92 that is a metal roller whose peripheral surface has been partially worked on to be a rough surface. This non-slip roller 92 is a single cylindrical roller made of, for example, stainless steel (SUS according to JIS) or the like. A peripheral surface of the non-slip roller 92 is provided with a plurality of rough surface portions 93 at a plurality of locations in the width direction X. In this modification, the rough surface portions 93 are provided at ten locations spaced by predetermined intervals in the width direction X of the non-slip roller 92. Each rough surface portion 93 is provided with a plurality of sharp-edged protrusions 94 over the circumference of the non-slip roller 92. That is, these protrusions 94 on the rough surface portion 93 function as protruded portions capable of having point contact with the sheet 14.

Figure 23:
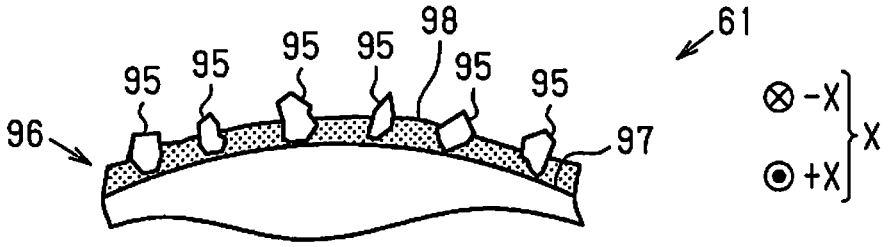
FIG. 23 is a schematic sectional view showing a portion of a ceramic roller that is a modification of the correction driving roller.
Figure 24:
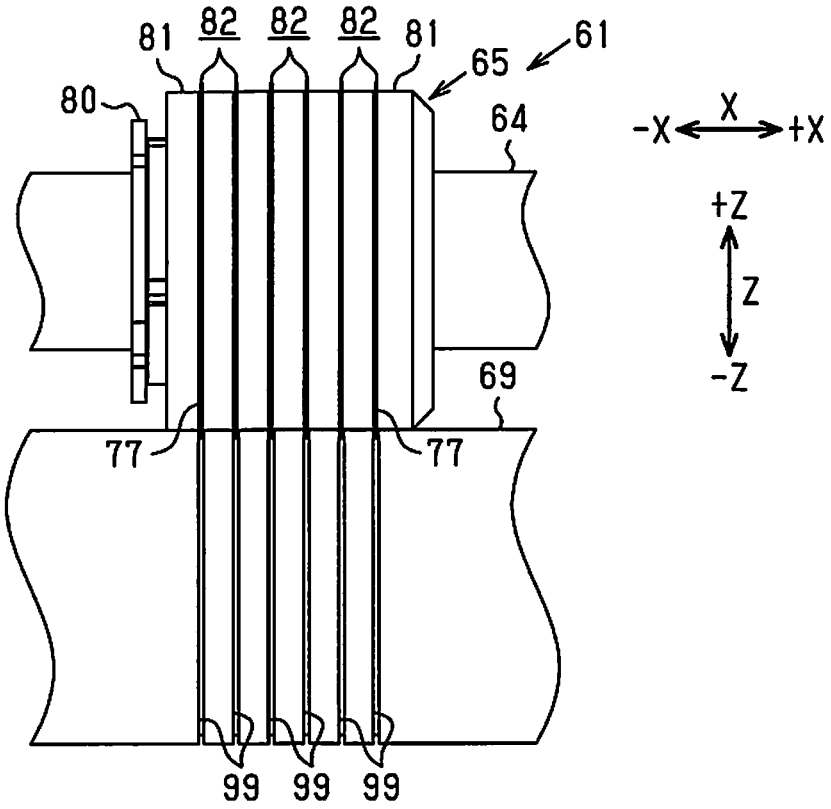
FIG. 24 is a front elevation showing a state in which a foam roller whose peripheral surface is provided with annular slits is in contact with a toothed roller.

As shown in FIG. 23, the correction driving roller 61 may be a ceramic roller 96 whose peripheral surface has a plurality of ceramic grains 95. In this ceramic roller 96, a plurality of ceramic grains 95 are embedded in a binder layer 98 formed on a peripheral surface of a substrate 97 made of a resin, a metal, etc. so that the ceramic grains 95 are protruded from the surface of the binder layer 98. That is, the ceramic grains 95 function as protruded portions capable of having point contact with the sheet 14 and the surface of the binder layer 98 functions as the peripheral surface of the correction driving roller 61. The particle size of the ceramic grains 95 is preferably 100 μm to 400 μm and more preferably 150 μm. If the particle size of the ceramic grains 95 is excessively large, the ceramic grains 95 are likely to fall apart from the binder layer 98. If the particle size thereof is excessively small, the ceramic grains 95 may possibly fail to sufficiently function as the protruded portions. The correction driving roller 61 is not limited to the foregoing modifications or the exemplary embodiment but may have any construction as long as the correction driving roller 61 has protruded portions capable of having point contact with the sheet 14.

As shown in FIGS. 24 to 28, in the foregoing exemplary embodiment, the foam rollers that function as the cleaning members 69 may have on their peripheral surfaces slits 99. In a modification shown in FIG. 24, the slits 99 formed on the peripheral surface of the cleaning members 69 are annularly formed so as to run along the teeth 77 of the toothed rollers 65. Specifically, the slits 99 extend in the circumferential direction of the cleaning members 69 and are arranged in groups of six annular slits separated from each other in the width direction X. The toothed rollers 65 are in contact with the cleaning members 69 so that the circumferentially juxtaposed teeth 77 in each of the six rows on the peripheral surface of each toothed roller 65 enters a corresponding one of the slits 99. This modification can achieve advantageous effects as follows, in addition to the advantageous effects of the foregoing exemplary embodiment.

(14) Because the teeth 77 enter the slits 99 on the foam rollers that form the cleaning members 69, side surfaces of the teeth 77 of the correction driving roller 61 can also be cleaned.

Figure 25:
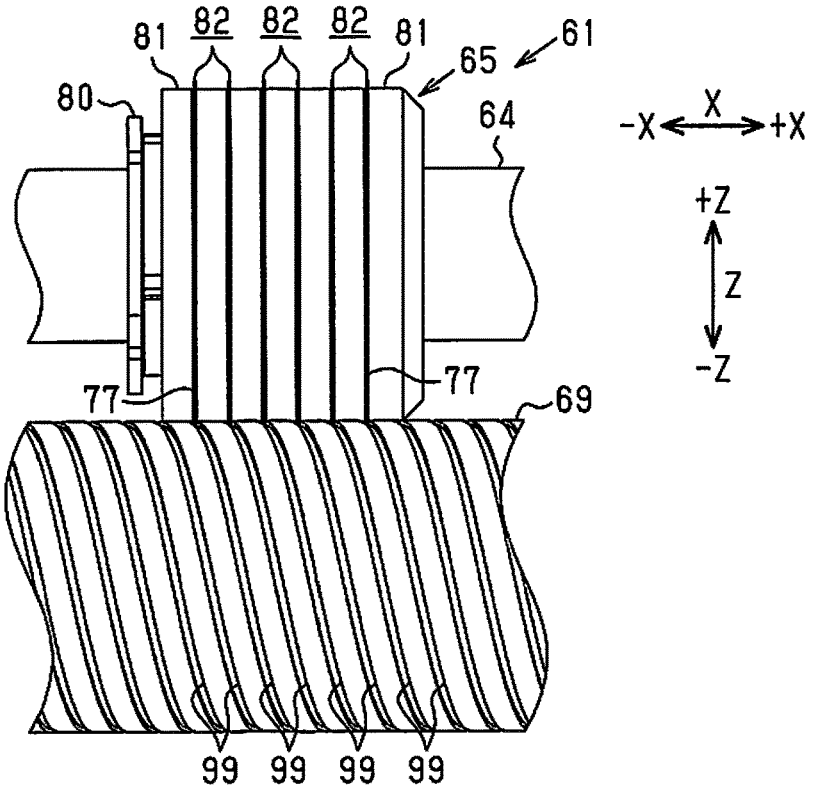
FIG. 25 is a front view showing a state in which a foam roller whose peripheral surface is provided with spiral slits is in contact with a toothed roller.
Figure 26:
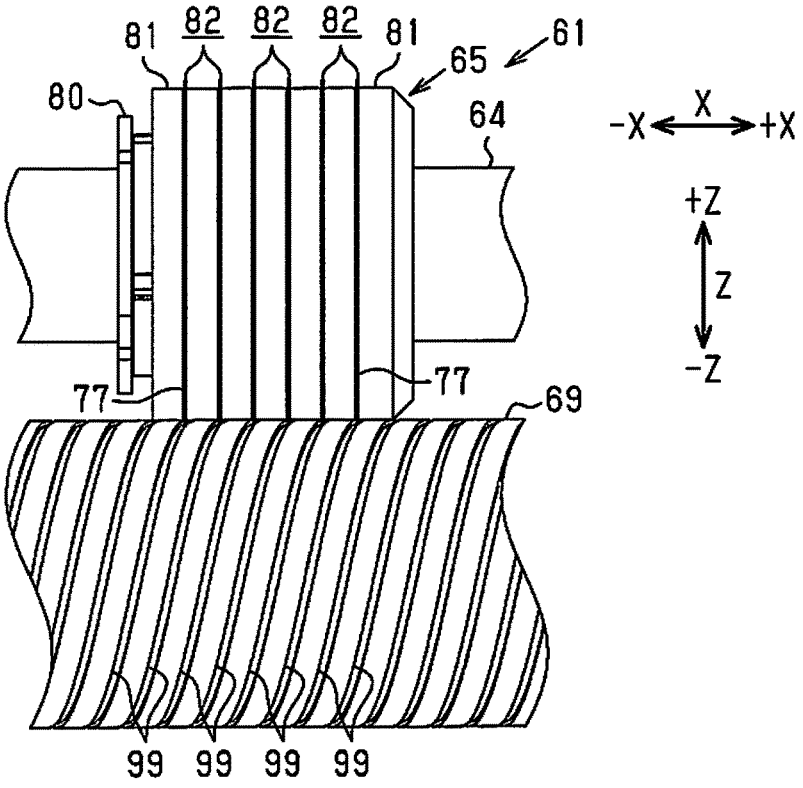
FIG. 26 is a front view showing a state in which a foam roller whose peripheral surface is provided with spiral slits is in contact with a toothed roller.

In modifications shown in FIGS. 25 and 26, a plurality of slits 99 are formed on the peripheral surface of the cleaning members 69 and extend obliquely to the rotation direction of the cleaning members 69, that is, to the circumferential direction thereof. Specifically, it can be said that the slits 99 extend spirally on the peripheral surface of the cleaning members 69. These modifications can achieve advantageous effects as follows, in addition to the advantageous effects of the foregoing exemplary embodiment.

(15) The slits 99 provide protuberances and depressions on the peripheral surfaces of the foam rollers that function as the cleaning members 69. Specifically, the correction driving roller 61 contacts the foam rollers so that the teeth 77 cross the protuberances and depressions formed on the peripheral surfaces of the foam rollers. Therefore, the cleaning effect of the cleaning members 69 can be improved.

Figure 27:
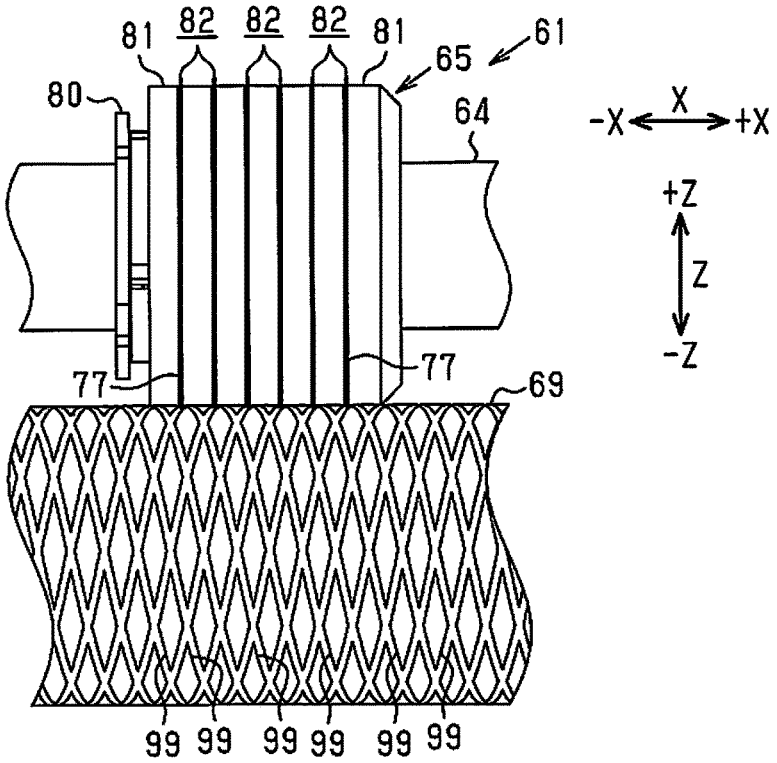
FIG. 27 is a front view showing a state in which a foam roller whose peripheral surface is provided with two kinds of spiral slits is in contact with a toothed roller.

Furthermore, as shown in FIG. 27, a plurality of slits 99 formed on the peripheral surface of each cleaning member 69 may intersect. These slits 99 extend obliquely to the rotation direction of the cleaning members 69 in a lattice form on the peripheral surface of each cleaning member 69.

Figure 28:
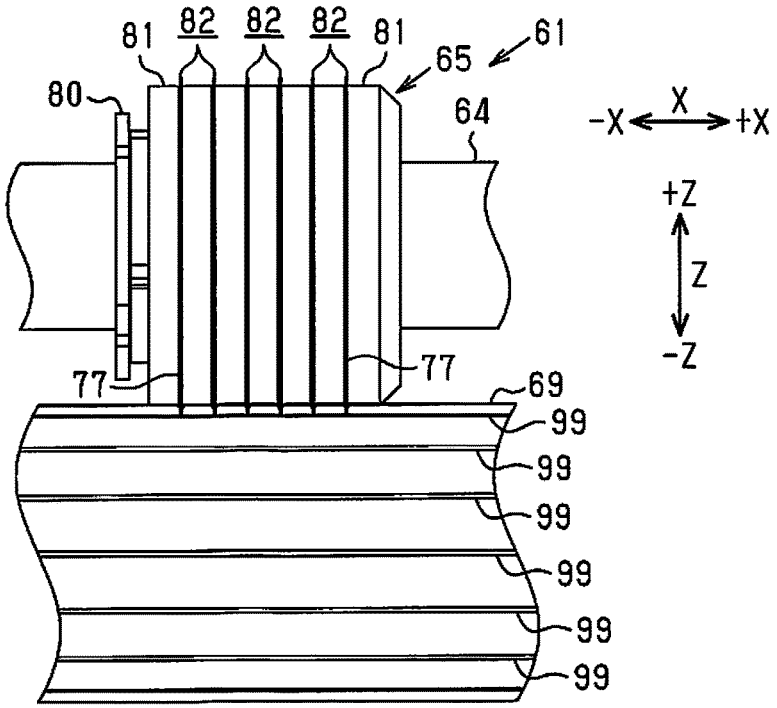
FIG. 28 is a front view showing a state in which a foam roller whose peripheral surface is provided with slits extending in an axis direction is in contact with a toothed roller.

Furthermore, as shown in FIG. 28, a plurality of slits 99 formed on the peripheral surface of each cleaning member 69 may extend in the width direction X (i.e., the direction of the axis of the cleaning members 69). The shape of the slits 99 is not limited to what are mentioned above. Furthermore, instead of the slits 99, a plurality of dot-shaped pits may be formed on the peripheral surface of each foam roller.

Figure 29:
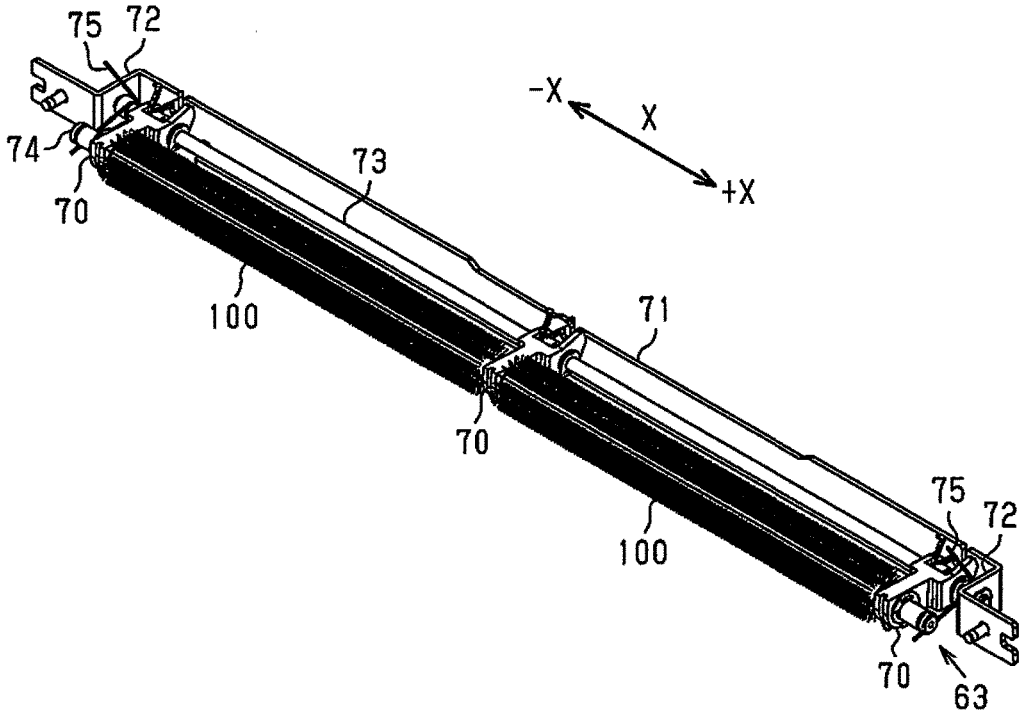
FIG. 29 is a perspective view of a roll brush according to a modification of the cleaning member.
Figure 30:
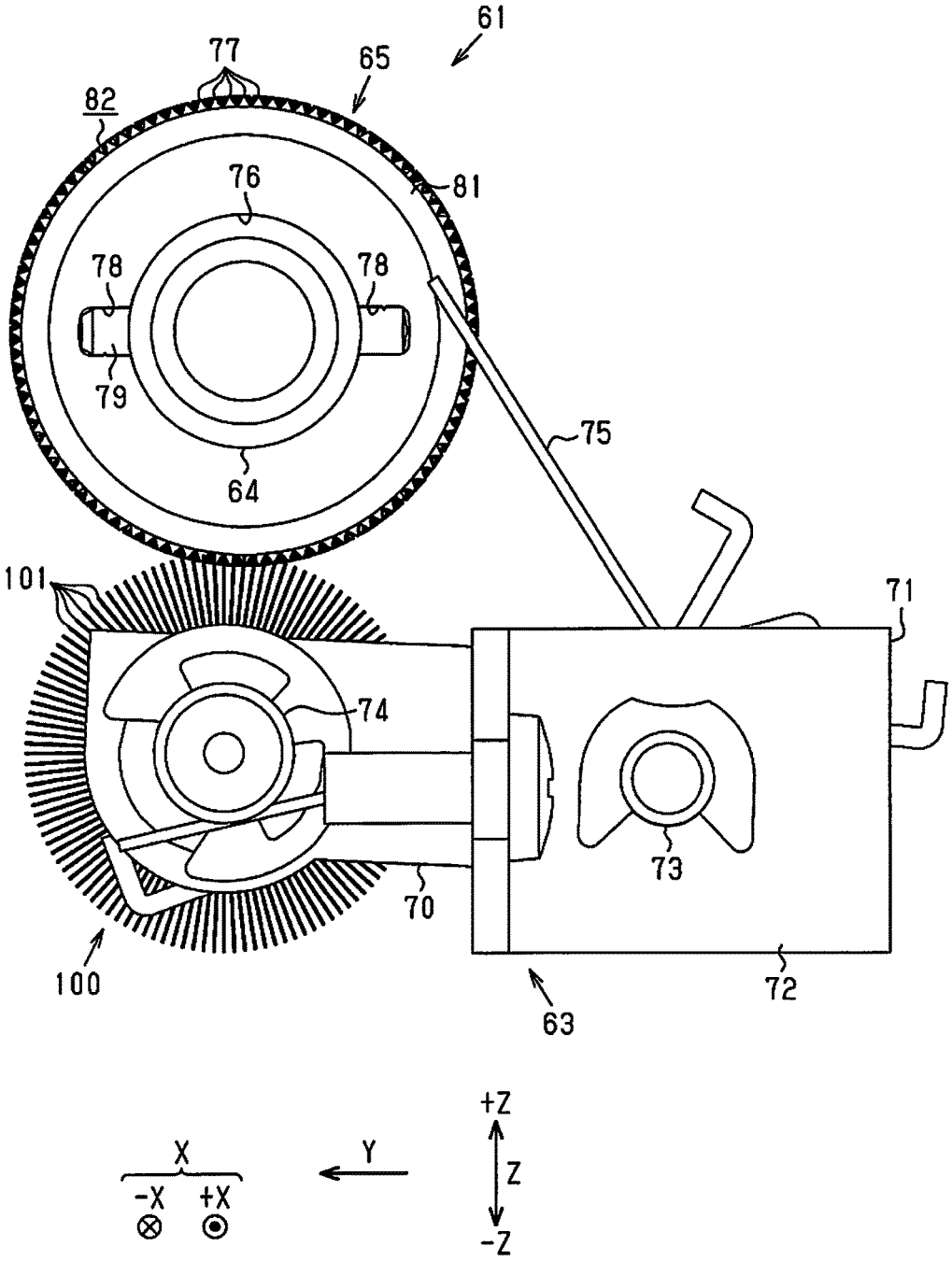
FIG. 30 is a side view showing a state in which the roll brush is in contact with a toothed roller.

As shown in FIGS. 29 and 30, in the foregoing exemplary embodiment, the cleaning members 69 may be roll brushes 100 that are rotatably supported by the shaft 74. Each roll brush 100 is provided with a plurality of brush hairs 101 extending in radial directions of the roll brush 100. The distal ends of the brush hairs 101 contact the toothed rollers 65 so as to clean the correction driving roller 61. In these roll brushes, the distal ends of the brush hairs 101 function as the peripheral surfaces of the cleaning members 69. Each roll brush 100 is formed by a method in which a base fabric having been napped so that a plurality of brush hairs 101 stand is wrapped spirally around the peripheral surface of a shaft member of the roll brush 100. This modification can achieve advantageous effects as follows, in addition to the advantageous effects of the foregoing exemplary embodiment.

(16) At the time of cleaning the correction driving roller 61, the roll brushes 100 that function as the cleaning members 69 contact the correction driving roller 61, so that the load that the cleaning imposes can be reduced.

In the foregoing exemplary embodiment, the teeth 77 of the toothed rollers 65 may be subjected to a water repellent finish, for example, by coating the teeth 77 with fluorine. This modification can achieve advantageous effects as follows, in addition to the advantageous effects of the foregoing exemplary embodiment.

(17) Removal of ink adhering to the teeth 77 of the correction driving roller 61 can be facilitated.

In the foregoing exemplary embodiment, the number of holders 81 and the number of toothed plates 82 provided in each of the toothed rollers 65 that constitute the correction driving roller 61 may be changed as appropriate. Furthermore, the correction driving roller 61 may also be made up of one toothed roller 65 elongated in the width direction X.

In the foregoing exemplary embodiment, the teeth 77 of each toothed roller 65 is not limited to arrangements in which the teeth 77 are arranged in rows on the peripheral surface of the toothed roller 65 but may randomly stand.

In the foregoing exemplary embodiment, the total number of teeth 77 of the toothed plates 82 may be changed as appropriate. The length of the pitch P of the teeth 77 may also be changed as appropriate.

In the foregoing exemplary embodiment, the number of toothed plates 82 that constitute each toothed roller 65 and the arrangement intervals of the toothed plates 82 may be changed as appropriate. For example, a toothed roller 65 may have a construction in which three toothed plates 82 are provided at arrangement intervals of 5 mm in the width direction X. In this case, if the total number of teeth 77 of the toothed plates 82 is set as, for example, 200, the number of toothed plates 82 of a toothed roller 65 can be changed without changing the total number of teeth 77 of the toothed roller 65. Furthermore, if the arrangement intervals of the toothed plates 82 are increased, it can be made easier for the cleaning members 69 to clean side surfaces of the teeth 77.

As for the correction roller pair 35 in the foregoing exemplary embodiment, the correction driven roller (second roller) 62 may actively rotate and the correction driving roller (first roller) 61 may be passively rotated. Furthermore, both rollers may actively rotate.

In the foregoing exemplary embodiment, the peripheral surface of the correction driven roller 62 is not limited to a uniform cylindrical surface without a protuberance nor a depression but may also be provided with protuberances and depressions. For example, the correction driven roller 62 may be made up of the ceramic roller 96 as shown in FIGS. 21 and 22.

In the foregoing exemplary embodiment, the teeth 77 of each toothed roller 65 do not necessarily need to be shifted from each other so that all the teeth 77 can be seen when the toothed roller 65 is viewed from the width direction X. For example, a construction in which a tooth 77 is perfectly superposed over another tooth 77 in a view from the width direction X may also be adopted.

In the foregoing exemplary embodiment, the angle of each of the peak portions 90 that are the distal ends of the teeth 77 is not limited to 60 degrees but may also be larger than or smaller than 60 degrees. Furthermore, the shape of the teeth 77 may also be rectangular.

In the foregoing exemplary embodiment, the cleaning members 69 are not limited to a construction in which the cleaning members 69 are passively rotated as the correction driving roller 61 rotates but may also be constructed to actively rotate. Furthermore, the cleaning members 69 are not limited to a construction in which the cleaning members 69 rotate but may also be constructed to translationally move to the upstream and downstream sides in the transport direction Y or may also be stationarily fixed to the casing 12.

In the foregoing exemplary embodiment, the switchback mechanism 40 that switches back the sheet 14 in order to perform two-side printing may be constructed to, for example, switch back the sheet 14 in the branch path 24 branching from the discharge path 25, send the sheet 14 into the discharge path 25, and then reversely send the sheet 14 from the discharge path 25 to the feed path 20 in a state in which the sheet 14 faces the printing unit 18. Furthermore, the switchback mechanism 40 may also have a construction in which the branch path 24 is not provided and the sheet 14 whose one side has been printed is switched back in the discharge path 25 and sent to the third feed path 23 that branches from the discharge path 25.

In the foregoing exemplary embodiment, the foam rollers that function as the cleaning members 69 do not necessarily need to be made of urethane foam but may also be made of other kinds of foamed plastics such as a melamine resin foam.

In the foregoing exemplary embodiment, the medium that the printing unit 18 prints is not limited to the paper sheet 14 but may also be other sheet-shaped media such as cloths or plastic films.

In the foregoing exemplary embodiment, the printing unit 18 may be a serial head that is movable along the width direction X.

In the foregoing exemplary embodiment, a support table that functions as a platen may be provided instead of the transport belt 51 that faces the printing unit 18.

In the foregoing exemplary embodiment, the printer 11 as a printing apparatus may also be a fluid discharging apparatus that performs printing by discharging or ejecting a fluid other than ink (which includes a liquid, a liquid material in which particles of a functional material are dispersed or mixed in a liquid, a fluidal material, such as a gel material, and a solid that can be discharged by causing it to flow as a fluid). For example, the printer 11 may also be a liquid material discharging apparatus that performs printing by discharging a liquid material that contains in a dispersed or dissolved state a material, such as an electrode material or a color material (pixel material), for use in, for example, production of a liquid crystal display an EL (electroluminescence) display, or a surface emitting display. Furthermore, the printer 11 may also be a fluidal material discharging apparatus that discharges a fluidal material such as a gel (e.g., a physical gel). The invention is applicable to any one of these fluid discharging apparatuses. Note that in this specification, the term "fluid" does not include a fluid that is made up of only gas and includes, for example, liquids (liquid (inorganic solvents, organic solvents, solutions, liquid resins, liquid metals (including metal melts, etc.), liquid materials, and fluidal materials), and so forth.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A transport roller adapted to be used in a transport apparatus that transports a medium, the transport roller comprising:

a shaft;

a wheel group including a first toothed plate and a second toothed plate arrayed in a direction in which the shaft extends, the first toothed plate and the second toothed plate being held by a holder which is held by the shaft;

a first set of teeth portions being provided on a peripheral surface of the first toothed plate; and a second set of teeth portions being provided on a peripheral surface of the second toothed plate, the first set of teeth portions and the second set of teeth portions being disposed to be shifted in position from each other in a circumferential direction of the wheel group when the wheel group is viewed from the direction in which the shaft extends.

2. The transport roller according to claim 1, wherein the shaft has a plurality of holders in the direction in which the shaft extends.

3. The transport roller according to claim 1, wherein each of the first toothed plate and the second toothed plate includes non-formation portions having no teeth which are cut portions that are formed when each of the first toothed plate and the second toothed plate is cut off from a base, the non-formation portions are provided on the peripheral surface of the wheel group, the non-formation portions being disposed to be shifted in position from each other in a circumferential direction of the wheel group when the wheel group is viewed from the direction in which the shaft extends.

4. The transport roller according to claim 3, wherein the teeth other than the teeth adjacent to the cut portions are arranged away from each other at regular intervals in a circumferential direction of the wheel group.

5. The transport roller according to claim 1, wherein the transport roller is a drive roller of a correction roller pair configured to correct skew of the medium.

6. A transport roller adapted to be used in a transport apparatus that transports a medium, the transport roller comprising:

a shaft; and a wheel group including a first toothed plate and a second toothed plate arrayed in a direction in which the shaft extends, the first toothed plate and the second toothed plate being held by a holder which is held by the shaft, the first toothed plate having a first set of teeth portions provided on a peripheral surface along a circumferential direction of the first toothed plate, the second toothed plate having a second set of teeth portions provided on a peripheral surface along a circumferential direction of the second toothed plate, and the first set of teeth portions and the second set of teeth portions being disposed to be shifted in position from each other in a circumferential direction of the wheel group when the wheel group is viewed from the direction in which the shaft extends.

7. A transport roller adapted to be used in a transport apparatus that transports a medium, the transport roller comprising:

a shaft; and a wheel group including a first toothed plate and a second toothed plate arrayed in a direction in which the shaft extends, the first toothed plate and the second toothed plate being held by a holder which is held by the shaft, the first toothed plate having a first set of teeth portions provided on a peripheral surface along a circumferential direction of the first toothed plate, the second toothed plate having a second set of teeth portions provided on a peripheral surface along a circumferential direction of the second toothed plate, and each of peak portions of the first set of teeth portions not overlapping each of peak portions of the second set of teeth portions when the wheel group is viewed from the direction in which the shaft extends.

* * * * *